US011234532B1

(12) United States Patent
Ruby et al.

(10) Patent No.: US 11,234,532 B1
(45) Date of Patent: Feb. 1, 2022

(54) CONVERTIBLE SOFA BED SYSTEM

(71) Applicant: Krug Inc., Kitchener (CA)

(72) Inventors: Leonard Ruby, Waterloo (CA); Cesar Fernandes, Cambridge (CA)

(73) Assignee: Krug Inc., Ontario (CA)

( * ) Notice: Subject to any disclaimer, the term of this patent is extended or adjusted under 35 U.S.C. 154(b) by 157 days.

(21) Appl. No.: 16/431,959

(22) Filed: Jun. 5, 2019

Related U.S. Application Data

(60) Provisional application No. 62/754,042, filed on Nov. 1, 2018, provisional application No. 62/680,778, filed on Jun. 5, 2018.

(51) Int. Cl.

| | |
|---|---|
| ***A47C 17/62*** | (2006.01) |
| ***A47C 17/04*** | (2006.01) |
| ***A47C 17/16*** | (2006.01) |
| ***A47C 17/20*** | (2006.01) |

(52) U.S. Cl.
CPC ..... *A47C 17/62* (2013.01); *A47C 17/045* (2013.01); *A47C 17/161* (2013.01); *A47C 17/20* (2013.01)

(58) Field of Classification Search
CPC ..... A47C 17/62; A47C 17/20; A47C 17/045; A47C 17/161; A47C 31/11; A47C 17/16; A47C 17/165; A47C 17/1655
See application file for complete search history.

(56) References Cited

U.S. PATENT DOCUMENTS

| | | | | |
|---|---|---|---|---|
| 481,385 A | | 8/1892 | Barger | |
| 2,028,426 A | | 1/1936 | Wunderlich | |
| 2,849,730 A | | 9/1958 | Polatsek | |
| 3,110,909 A | * | 11/1963 | Bendell | A47C 17/36 5/12.1 |
| 4,106,137 A | | 8/1978 | Leclerc | |
| 4,292,698 A | * | 10/1981 | Acker | A47C 17/1655 297/216.13 |
| 4,538,308 A | * | 9/1985 | Grigoriev | A47C 17/161 297/105 |
| 4,543,675 A | * | 10/1985 | Shrock | A47C 17/161 5/18.1 |
| 5,842,743 A | | 12/1998 | Wright et al. | |
| 6,904,628 B2 | | 6/2005 | Murphy et al. | |
| D613,960 S | | 4/2010 | Griepenlrog et al. | |
| D716,576 S | * | 11/2014 | Wieland | D6/381 |
| 9,027,178 B2 | | 5/2015 | Wieland et al. | |
| 9,125,496 B2 | | 9/2015 | Wieland et al. | |
| 9,314,104 B2 | | 4/2016 | Stieglitz et al. | |
| 9,907,404 B1 | * | 3/2018 | Sorel | A47C 17/161 |
| 9,980,572 B2 | * | 5/2018 | Thurow | A47C 17/17 |

(Continued)

*Primary Examiner* — Robert G Santos
*Assistant Examiner* — Alison N Labarge

(57) ABSTRACT

A convertible sofa bed system positionable on a floor. The convertible sofa bed system includes a back support assembly having a frame, and a back cushion assembly connected with the back support assembly and movable between a raised condition and a lowered condition thereof. The system also includes one or more body modules secured to the frame. The body module includes an at least partially planar top surface positionable at a predetermined elevation above the floor. The body module is formed to cooperate with the back cushion assembly in the raised condition to define a seating configuration, and to cooperate with the back cushion assembly in the lowered condition to define a sleeping configuration.

12 Claims, 26 Drawing Sheets

(56) References Cited

U.S. PATENT DOCUMENTS

| | | | | |
|---|---|---|---|---|
| 2006/0012228 | A1* | 1/2006 | Bardouche | A47C 31/11 297/228.12 |
| 2007/0102975 | A1 | 5/2007 | Gardner | |
| 2012/0131745 | A1* | 5/2012 | Wieland | A47C 7/506 5/2.1 |
| 2013/0047333 | A1* | 2/2013 | Wieland | A47C 17/163 5/3 |
| 2020/0337467 | A1* | 10/2020 | Cannon | A47C 17/2076 |

* cited by examiner

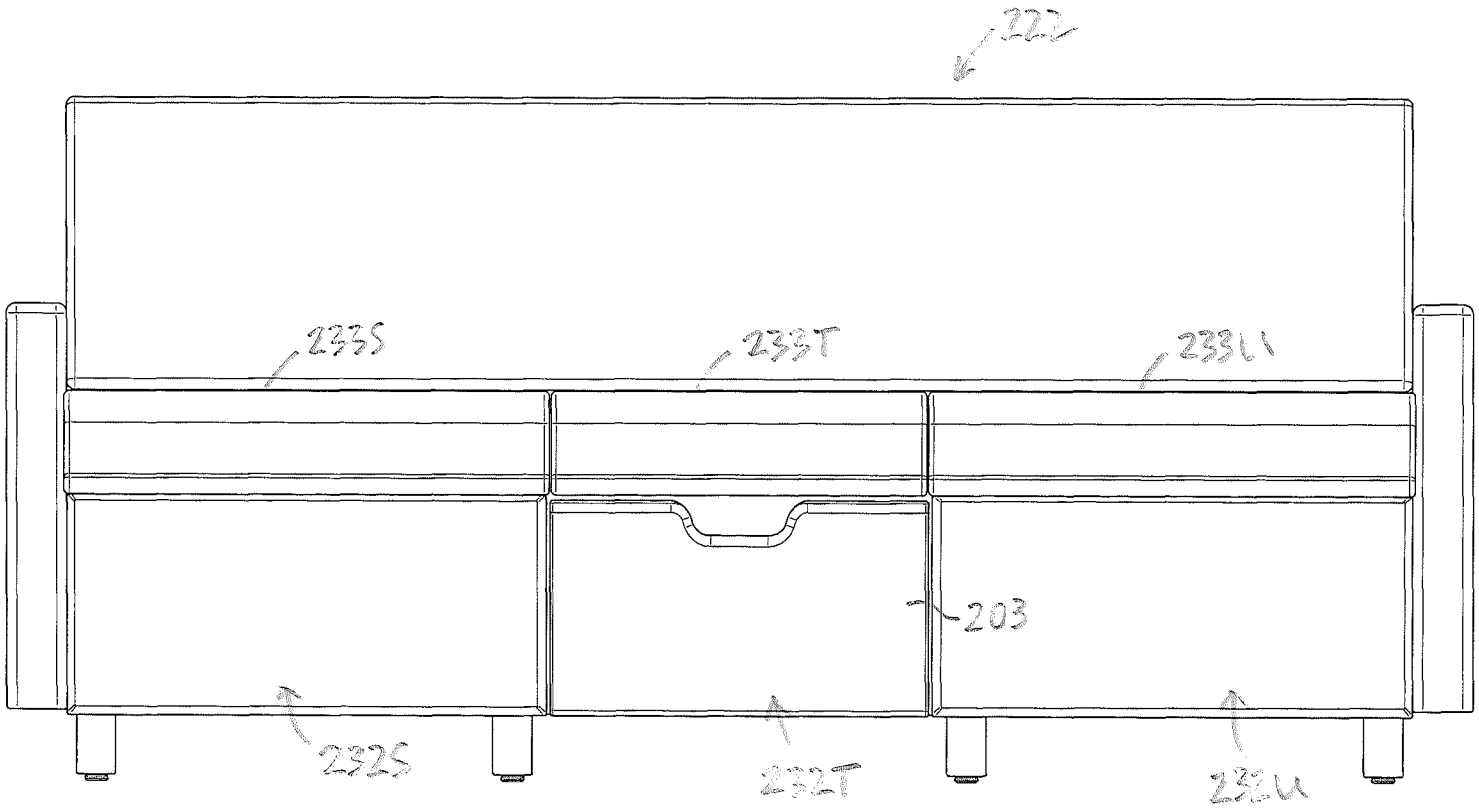
222
1332
1332
1332

CONVERTIBLE SOFA BED SYSTEM

CROSS-REFERENCE TO RELATED APPLICATION

This application claims the benefit of U.S. Provisional Patent Application No. 62/680,778, filed on Jun. 5, 2018, and U.S. Provisional Patent Application No. 62/754,042, filed on Nov. 1, 2018, the entirety of each of which is hereby incorporated by reference.

FIELD OF THE INVENTION

The present invention is a convertible sofa bed system.

BACKGROUND OF THE INVENTION

In the typical convertible sofa bed, the construction thereof involves a frame to which a number of discrete elements are permanently secured. The discrete elements may include, for example, back cushions supported by the frame, and the back cushions typically are connected to the frame by hinges.

SUMMARY OF THE INVENTION

There is a need for a convertible sofa bed system that overcomes or mitigates one or more of the disadvantages or defects of the prior art. Such disadvantages or defects are not necessarily included in those listed above.

In its broad aspect, the invention provides a convertible sofa bed system positionable on a floor. The convertible sofa bed system includes a back support assembly extending between first and second ends thereof, and having a frame and a back cushion assembly connected with the back support assembly and movable between a raised condition and a lowered condition thereof. The convertible sofa bed system also includes one or more body modules secured to the frame. The body module includes an at least partially planar top surface positionable at a predetermined elevation above the floor. The body module is formed to cooperate with the back cushion assembly in the raised condition to define a seating configuration, and to cooperate with the back cushion assembly in the lowered condition to define a sleeping configuration.

In one of its aspects, the back cushion assembly is connected with the frame by one or more tether elements.

In another of its aspects, the back support assembly has a front side thereof facing toward the one or more body modules, and an opposed back side thereof, and the back support assembly includes a back cover at the back side, to at least partially cover the frame.

In yet another aspect, the back cover is openable to provide an opening that permits access to the frame, and the back cover includes a device for closing the opening. The tether element is, via the opening, connectable and disconnectable from the frame.

In another of its aspects, the convertible sofa bed system includes a back support assembly having a front side and an opposed back side thereof, the back support assembly extending between first and second ends thereof, and the back support assembly including a frame. The system also includes a number of body modules secured to the frame. The body modules include first and second body modules located proximal to the first and second ends respectively, and a central body module located between the first and second ends. The body modules respectively include first and second at least partially planar top surfaces, and a central at least partially planar top surface. The first and second body modules include first and second bases respectively. The first and second bases at least partially support the first and second at least partially planar top surfaces respectively. The center body module includes a central seat cushion subassembly comprising a central cushion having the at least partially planar central top surface and an opposed central bottom surface. The central seat cushion subassembly extends between an inner side thereof that is located proximal to the front side of the back support assembly, and an outer side thereof that is spaced apart from the front side of the back support assembly by a predetermined distance. The center body module also includes a table element connected to the central seat cushion subassembly at the outer side thereof, the table element being located relative to the at least partially planar central bottom surface to define a predetermined angle therebetween. The center body module also includes a connecting assembly connecting the central seat cushion subassembly to the first and second bases, for pivoting movement of the central seat cushion subassembly between a first position, in which the at least partially planar top surface of the central cushion is aligned with the first and second at least partially planar central top surfaces of the respective first and second body modules, and a second position, in which the seat cushion subassembly is positioned to locate the table element in a substantially horizontal position.

BRIEF DESCRIPTION OF THE DRAWINGS

The invention will be better understood with reference to the attached drawings, in which:

FIG. 9A is a front view of the convertible sofa bed system of FIG. 8A;

DETAILED DESCRIPTION

Figure 1A:
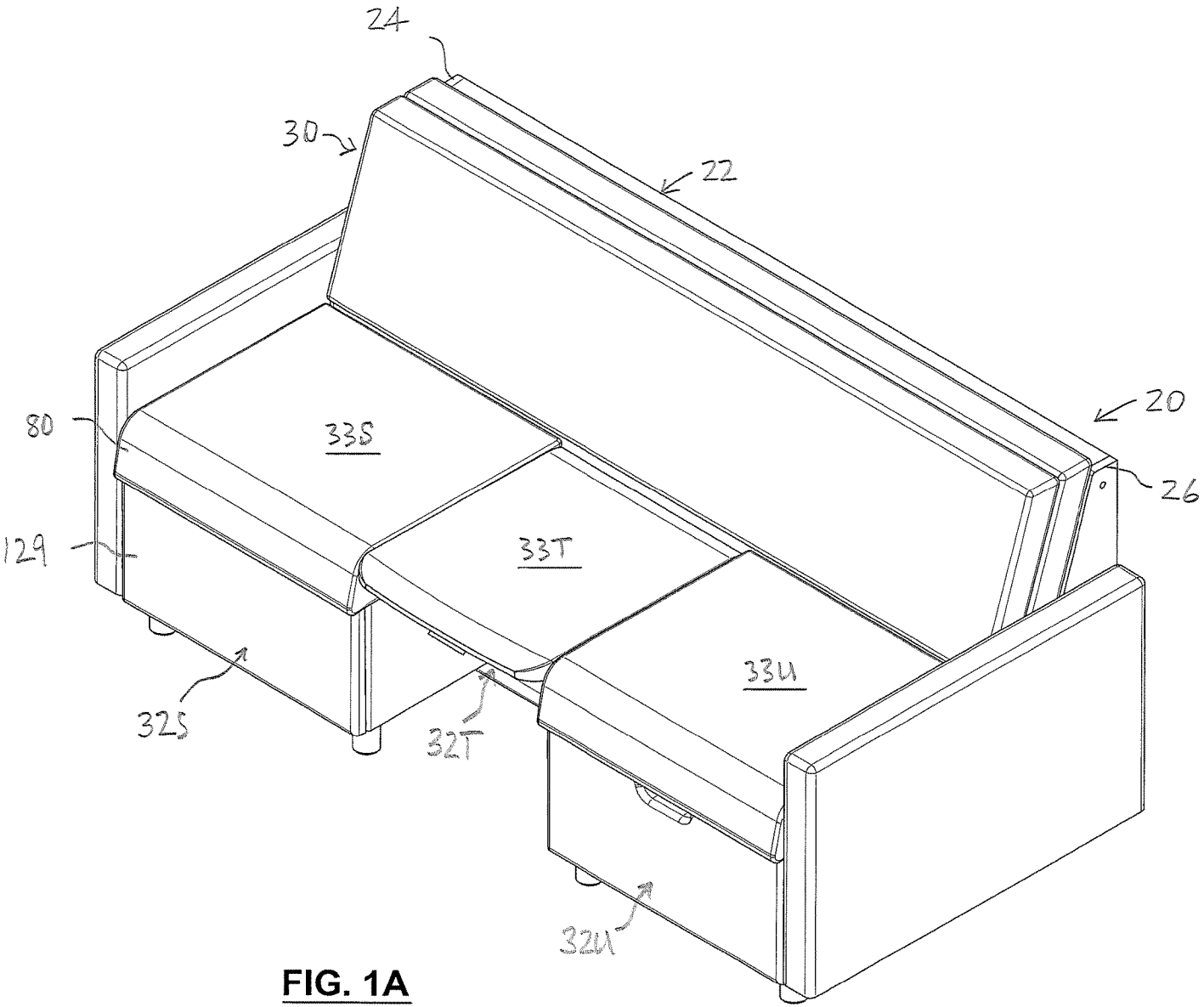
FIG. 1A is an isometric view of an embodiment of a convertible sofa bed system of the invention in which a back cushion assembly is in a raised condition, so that the system is in a seating configuration.
Figure 1B:
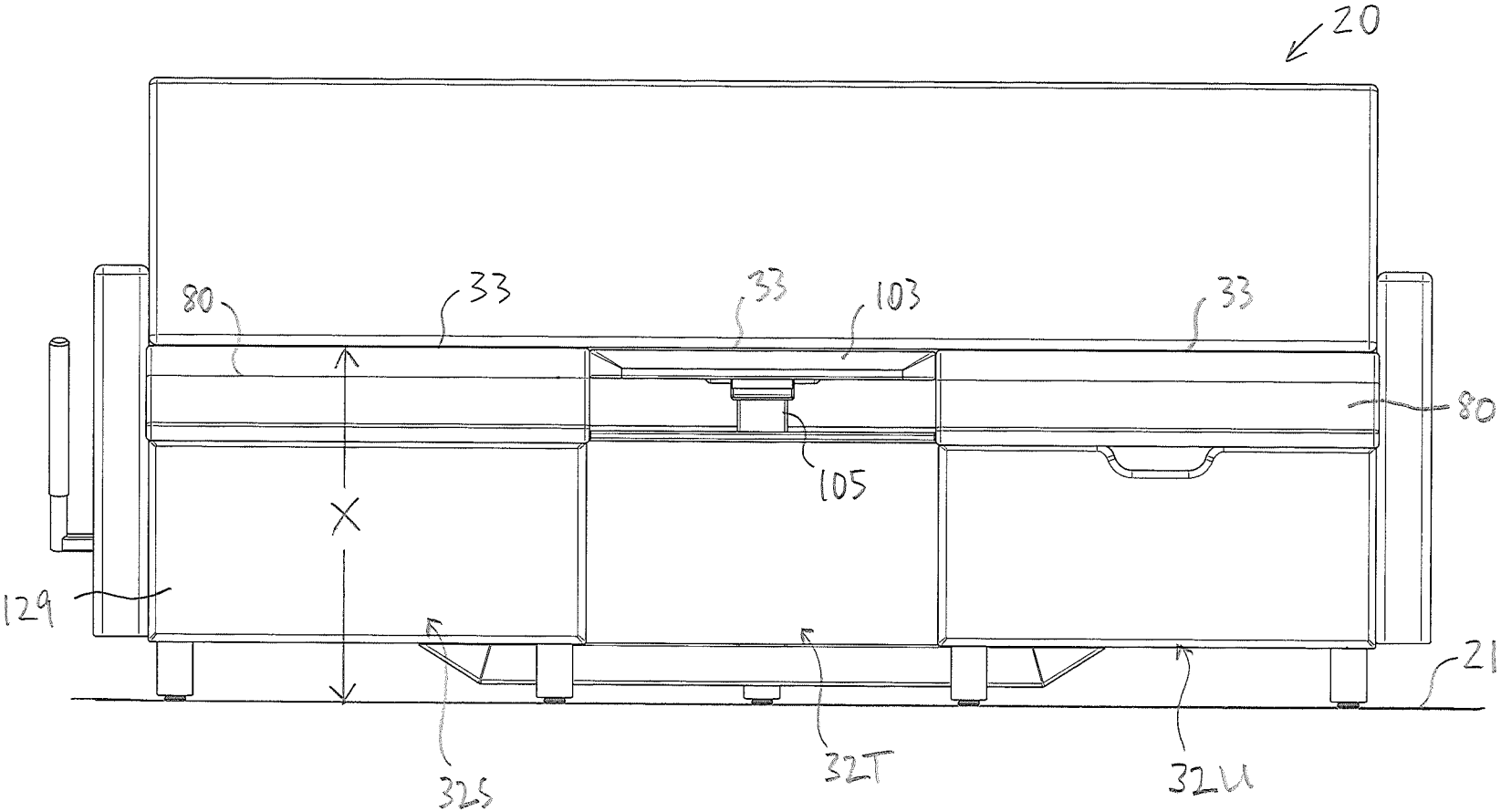
FIG. 1B is a front view of the convertible sofa bed system of FIG. 1A, drawn at a larger scale.
Figure 1C:
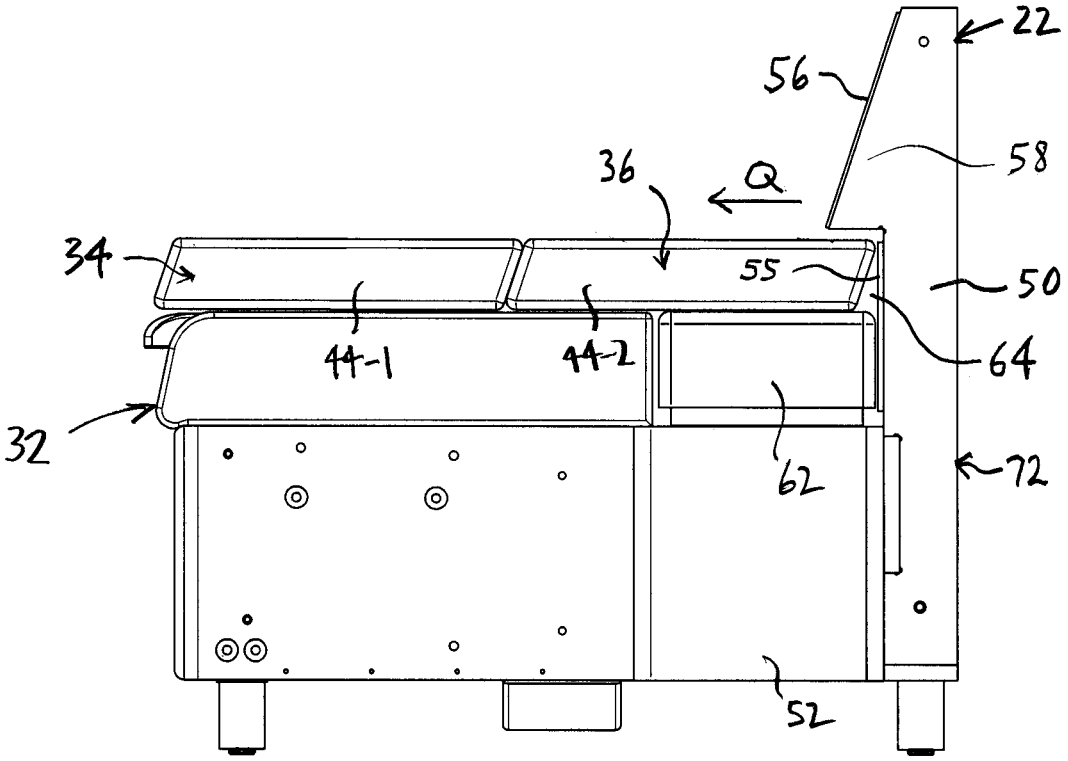
FIG. 1C is a side view of a portion of the convertible sofa bed system of FIGS. 1A and 1B in which the back cushion assembly is in a lowered condition, so that the system is in a sleep configuration.
Figure 1D:
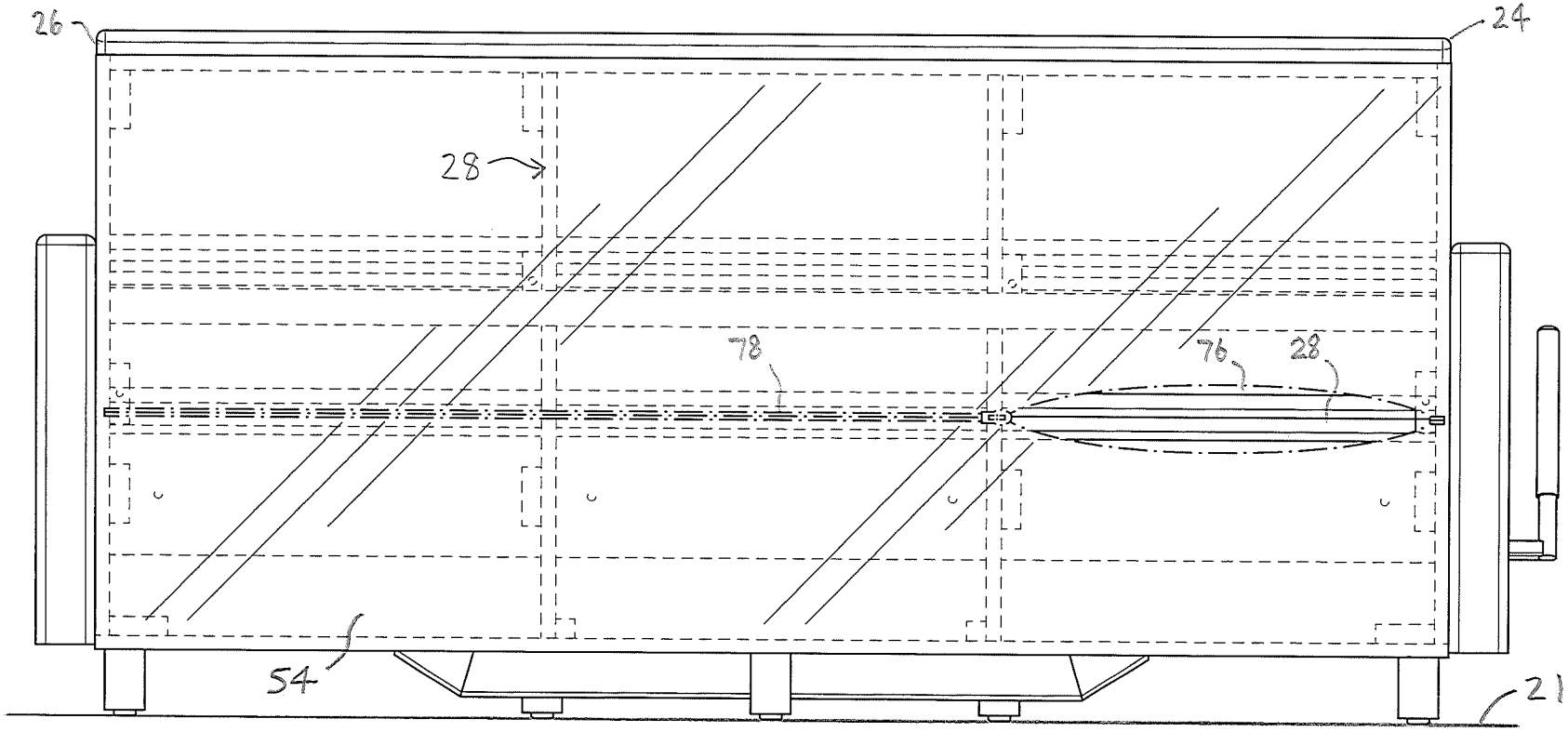
FIG. 1D is a back view of the convertible sofa bed system of FIGS. 1A-1C.
Figure 1E:
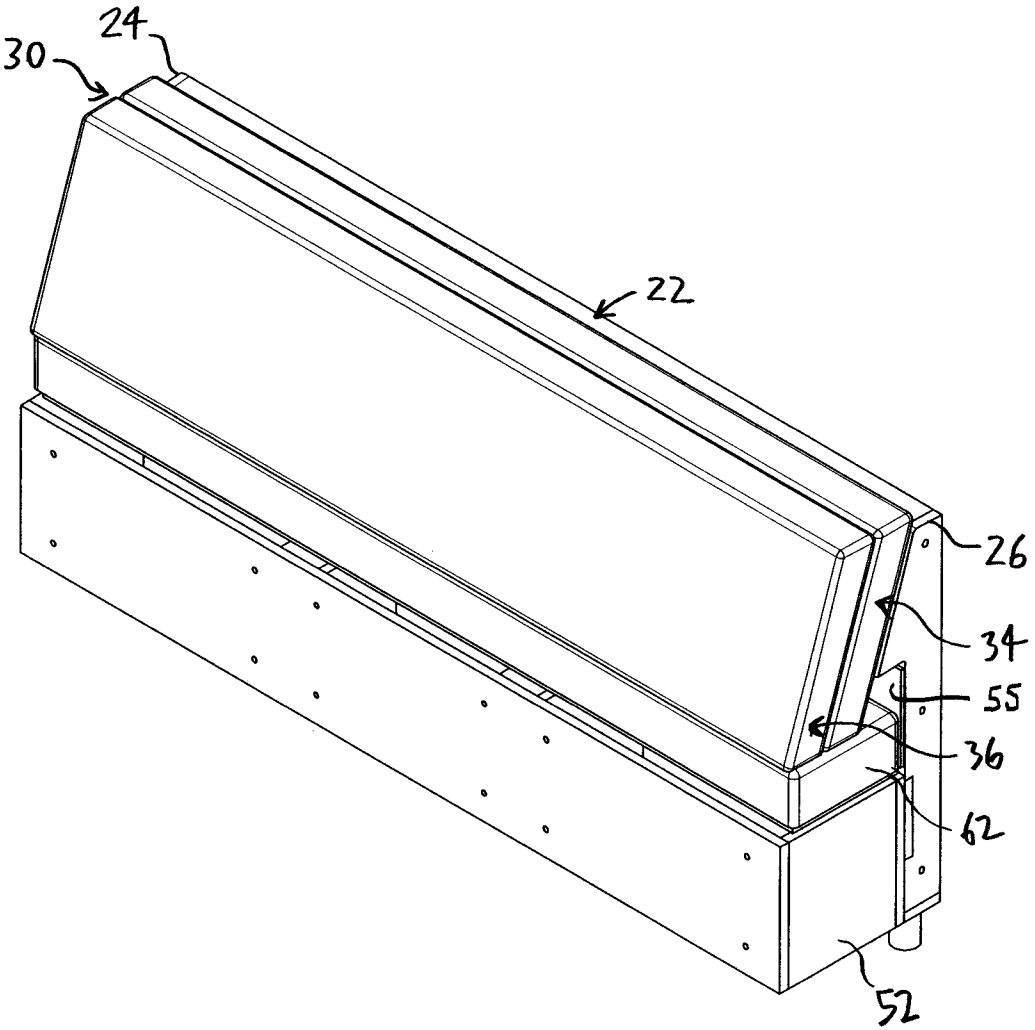
FIG. 1E is an isometric view of an embodiment of the back support assembly of the invention, with the back cushion assembly positioned on the back support assembly in the raised condition, drawn at a smaller scale.

In the attached drawings, like reference numerals designate corresponding elements throughout. Reference is first made to FIGS. 1A-7D to describe embodiments of the convertible sofa bed system of the invention indicated generally by the numeral 20. The convertible sofa bed system 20 is positionable on a floor 21 (FIG. 1B). In one embodiment, the convertible sofa bed system 20 preferably includes a back support subassembly 22 extending between first and second ends 24, 26 thereof. As will be described, the back support assembly 22 preferably includes a frame 28 (FIG. 1D).

Figure 1F:
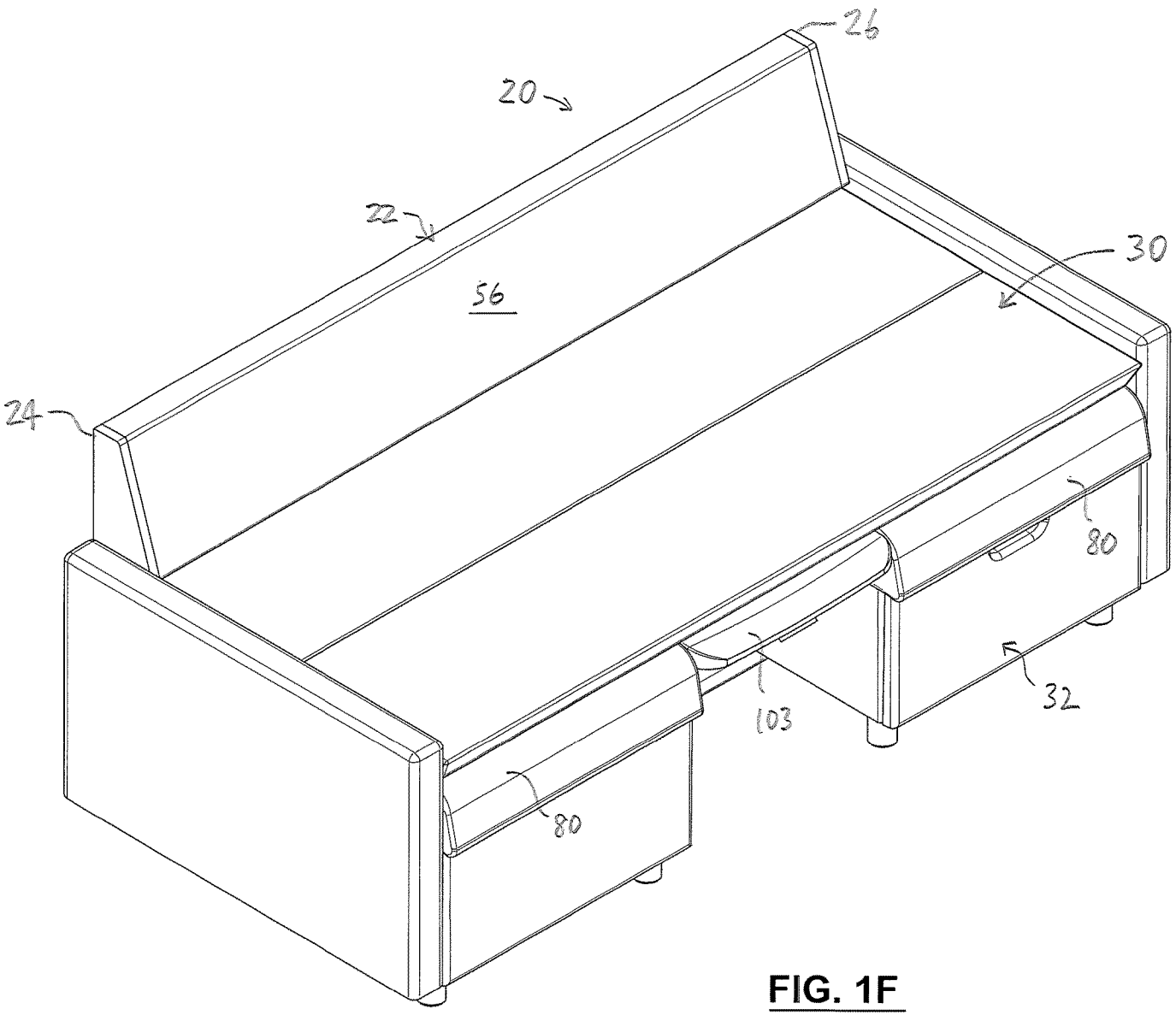
FIG. 1F is an isometric view of the convertible sofa bed system of FIG. 1A in which the back cushion assembly is in the lowered condition, and the convertible sofa bed system is in the sleeping configuration.
Figure 2A:
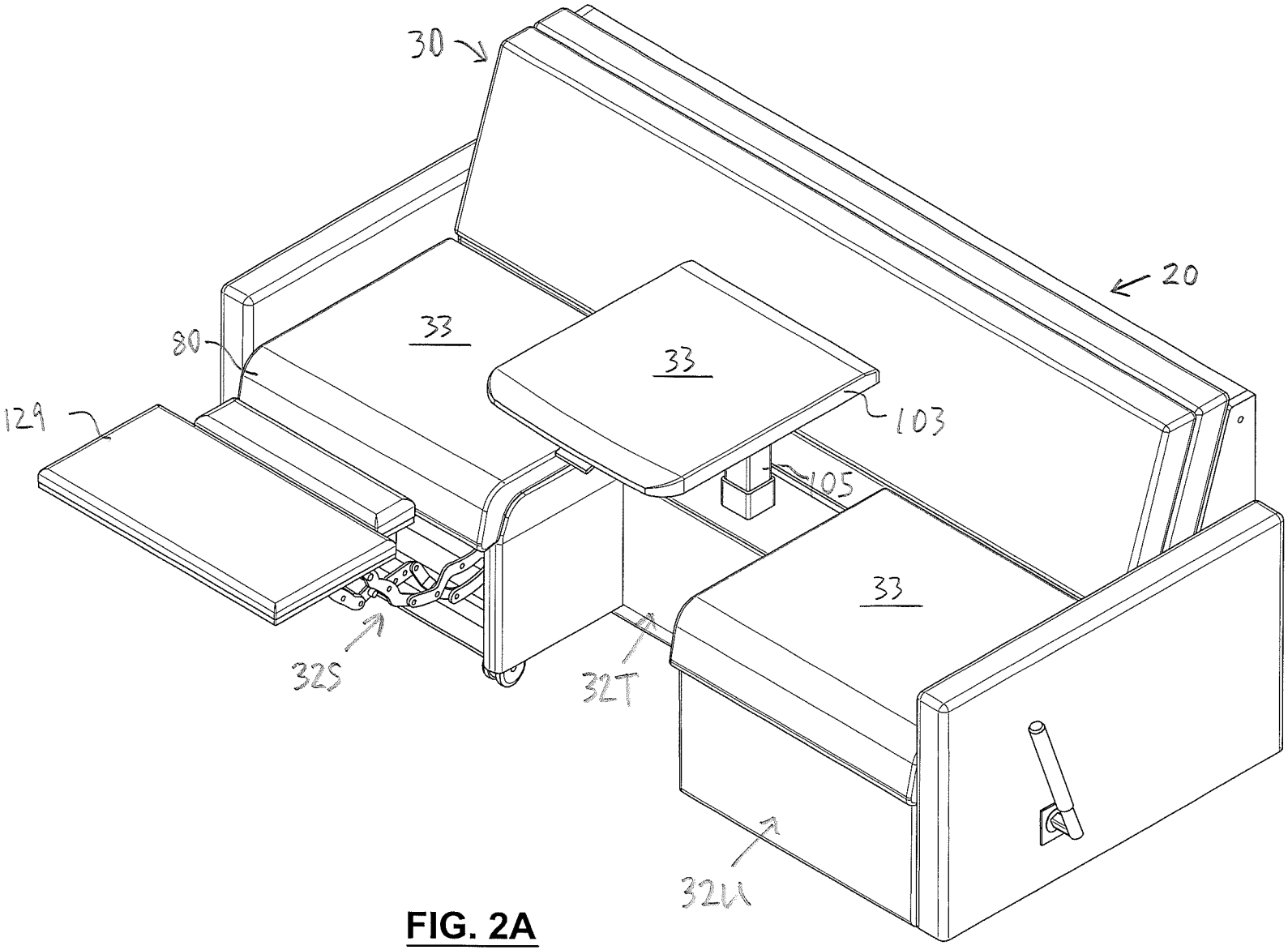
FIG. 2A is an isometric view of another embodiment of the convertible sofa bed of the invention.
Figure 2B:
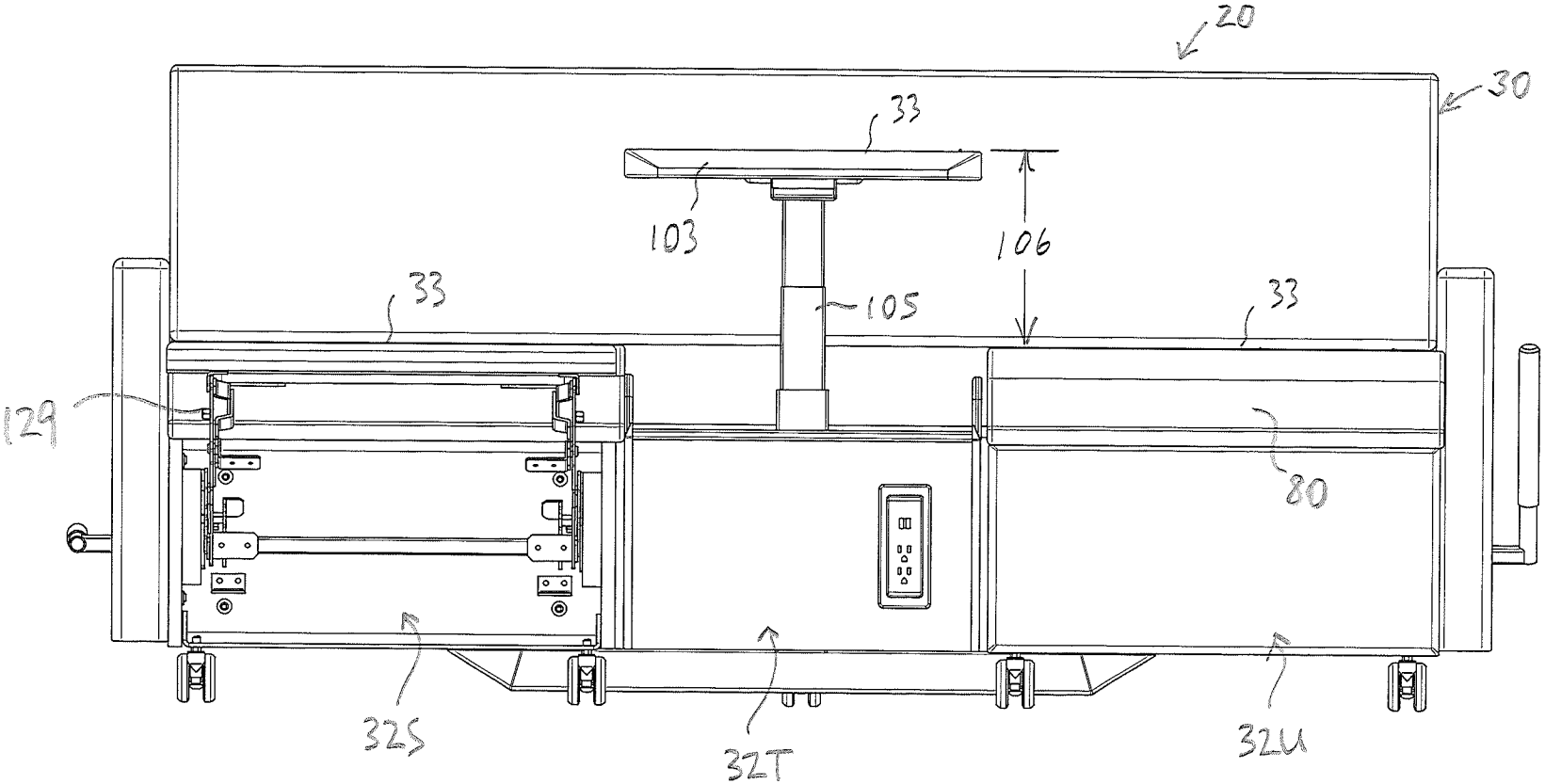
FIG. 2B is a front view of the convertible sofa bed system of FIG. 2A, drawn at a larger scale.
Figure 7A:
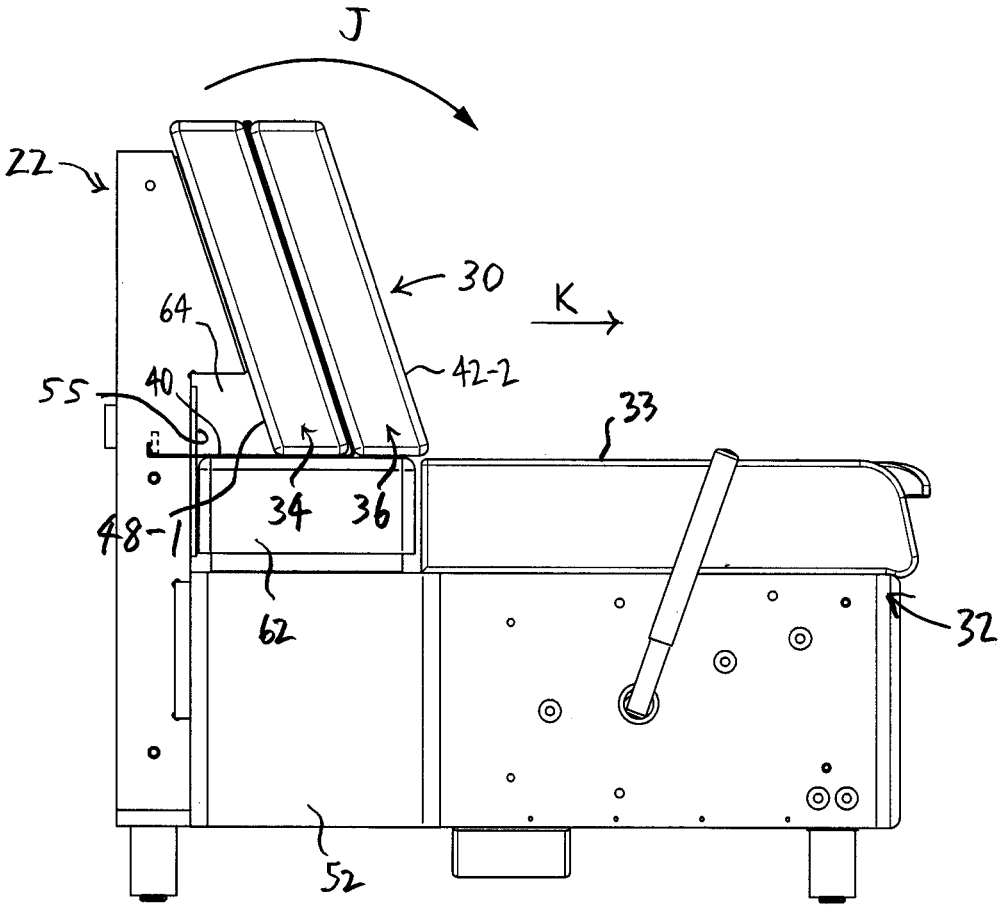
FIG. 7A is a side view of the back cushion assembly in the raised condition.

The convertible sofa bed system 20 preferably also includes one or more back cushion assemblies 30 movable between a raised condition (FIG. 7A) and a lowered condition (FIG. 7C) thereof. The back cushion assembly 30 preferably is connected with the back support assembly 22, as will also be described. It is also preferred that the system 20 includes one or more body modules 32 secured to the frame 28. Each of the body modules 32 preferably includes an at least partially planar top surface 33 positionable at a predetermined elevation "X" above the floor 21 (FIG. 1B). It is preferred that the body module 32 is formed to cooperate with the back cushion assembly 30 in the raised condition to define a seating configuration (FIGS. 1A, 7A). Also, the body module 32 preferably is formed to cooperate with the back cushion assembly 30 in the lowered condition to define a sleeping configuration (FIGS. 1C, 1F).

Figure 7B:
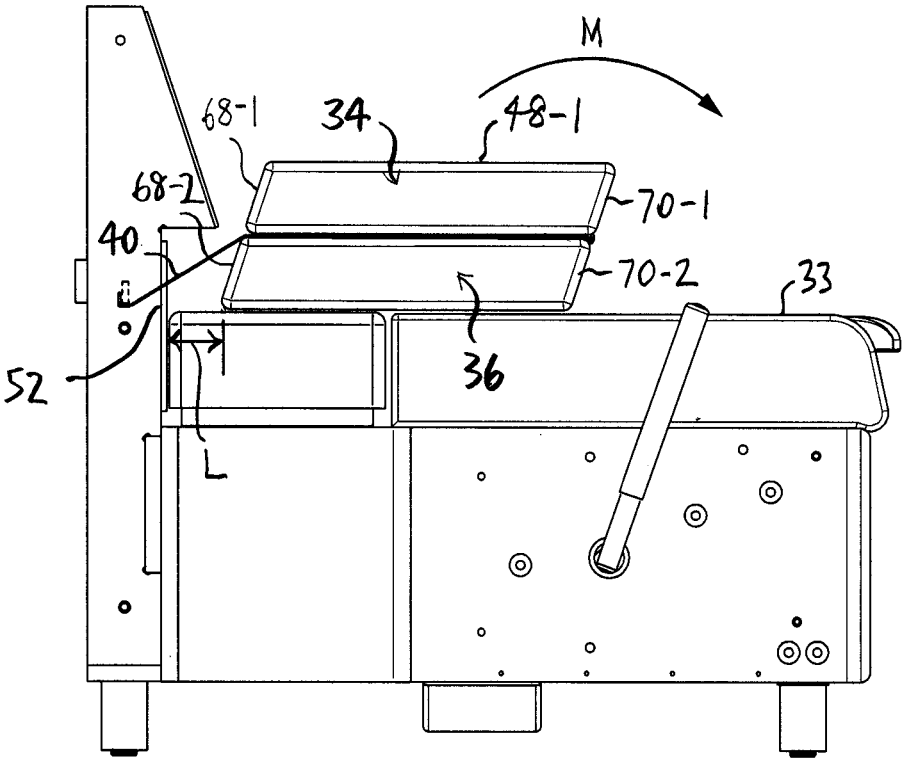
FIG. 7B is a side view of the back cushion assembly of FIG. 7A in an intermediate condition thereof, between the raised and lowered conditions.
Figure 7C:
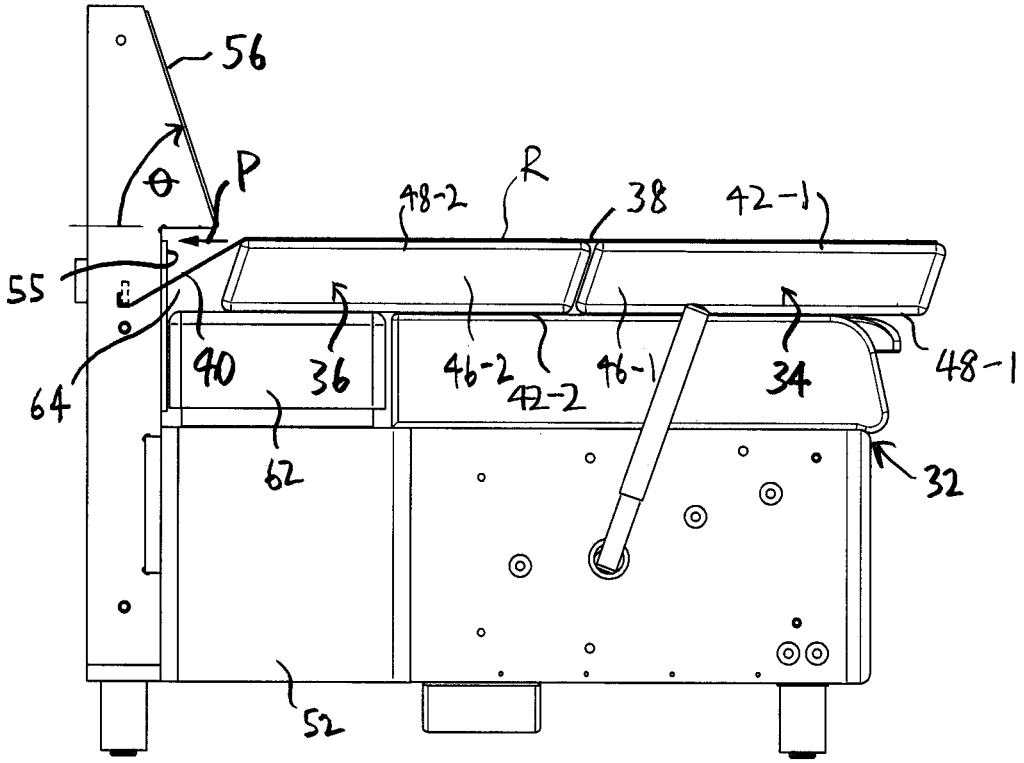
FIG. 7C is a side view of the back cushion assembly of FIGS. 7A and 7B in the lowered condition thereof.
Figure 7D:
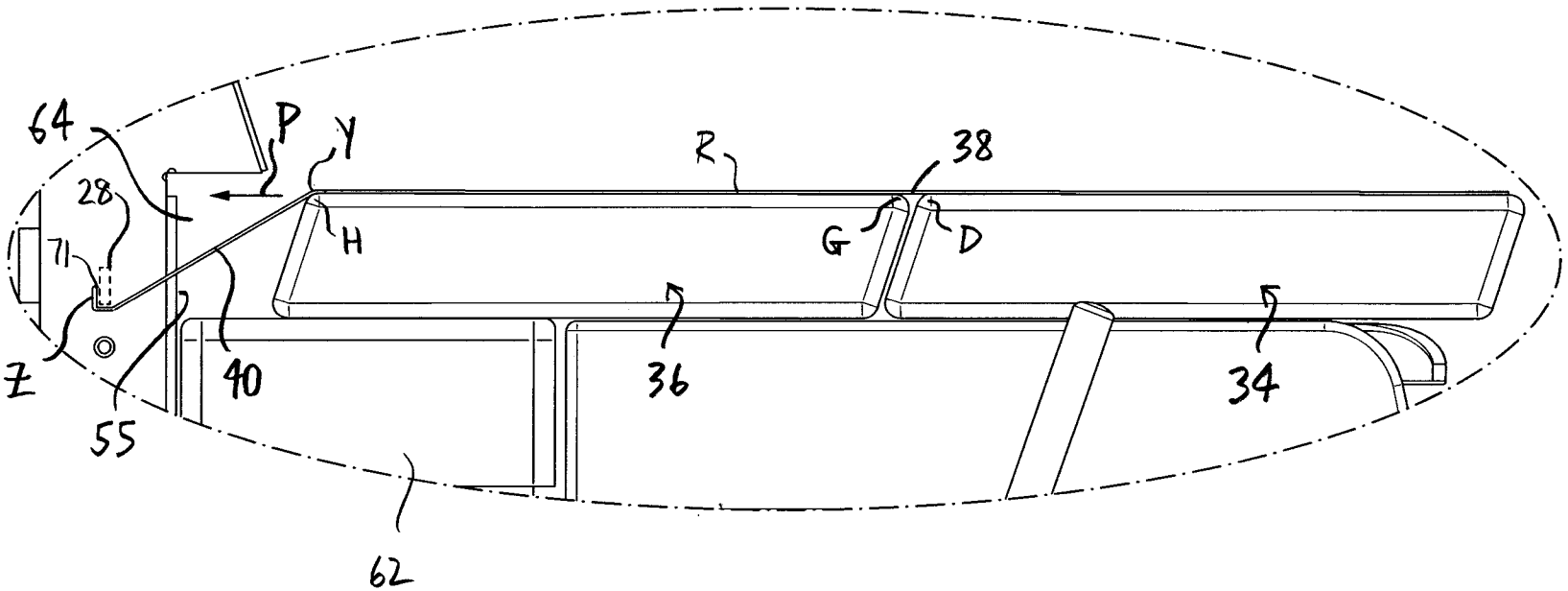
FIG. 7D is a portion of the side view of FIG. 7C, drawn at a larger scale.

As can be seen in FIGS. 7A and 7B, it is also preferred that the back cushion assembly 30 is movable into an intermediate condition between the raised and lowered conditions thereof. The back cushion assembly 30 is shown in the intermediate condition in FIG. 7B. Preferably, the back cushion assembly 30 includes a first cushion 34, a second cushion 36, and one or more connecting elements 38, connecting the first and second cushions 34, 36 (FIGS. 7C, 7D). It is also preferred that the back cushion assembly 30 is connected with the frame 28 by one or more tether elements 40, as will be described (FIGS. 7A-7D). The tether element 40 preferably is flexible. As will also be described, because the tether element 40 is flexible, limited horizontal movement of the back cushion assembly 30 relative to the back support assembly 22 is thereby permitted.

As can be seen in FIGS. 7A-7D, the first and second cushions 34, 36 preferably are each in the form of a parallelepiped. The second cushion 36 has a front side 42-2, left and right sides 44-2, 46-2, and a back side 48-2 (FIGS. 1C, 7A-7D). The first cushion 34 preferably has corresponding sides, i.e., a front side 42-1, left and right sides 44-1, 46-1, and a back side 48-1.

As can be seen in FIG. 7A, when the back cushion assembly 30 is in the raised condition thereof, the first cushion 34 preferably engages the back support assembly 22, and the second cushion 36 preferably is partially supported by the first cushion 34. As can also be seen in FIGS. 1C and 1E, in one embodiment, the frame 28 preferably includes a housing element 50 and a back support lower element 52. The housing element 50 preferably is covered by a cover element 54 (FIG. 1D), as will be described.

The back support assembly 22 has a front side 55 thereof, and the front side 55 of the housing 50 preferably includes an upper surface 56 that is generally planar, and facing generally forwardly and upwardly (FIGS. 1C, 1F). The upper surface 56 preferably is included in a back support upper element 58 of the back support assembly 22 (FIG. 1C).

As can be seen in FIG. 1C, the back support assembly 22 preferably also includes a back support cushion 62, which is supported by the back support lower element 52. It is also preferred that a recess 64 is defined by the front side 55 of the back support assembly 22 and the back support cushion 62 (FIG. 1C).

It is also preferred that, when the back cushion assembly 30 is in the intermediate condition (FIG. 7B), the second cushion 36 engages the at least partially planar top surface 33 of the body module 32, and the first cushion 34 engages the second cushion 36. As will be described, the back cushion assembly 30 may be put into in the intermediate condition (FIG. 7B) when the back cushion assembly 30 is being moved from the raised condition to the lowered condition, or when the back cushion assembly 30 is being moved from the lowered condition to the raised condition.

Preferably, and as can be seen in FIGS. 1C and 7C, when the back cushion assembly 30 is in the lowered condition, the first and second cushions 34, 36 engage the at least partially planar top surface 33 of the body module 32.

As can be seen in FIG. 7C, when the back cushion assembly 30 is first moved to the lowered condition, the second cushion 36 preferably is spaced apart from the front side 55 of the housing 50. In order to put the system 20 into the sleeping configuration, it is preferred that the first and second cushions 34, 36 are pushed in the direction indicated by arrow "P" in FIG. 7C, so that the second cushion 36 is located partially in the recess 64, as illustrated in FIG. 1C. Also, in order to move the system 20 from the sleeping configuration to the seating configuration, the first and second cushions are initially moved in the direction indicated by arrow "Q" in FIG. 1C, until the second cushion 36 is out of the recess 64. This outward shift positions the first cushion 34 to avoid the back support upper element 58, when the back cushion assembly 30 is moved from the lowered condition to the intermediate condition. As can be seen in FIGS. 7C and 7B, once the first and second cushions 34, 36 have been moved sufficiently outwardly from the front side 55 of the housing 50, the back cushion assembly 30 can be moved from the lowered condition (FIG. 7C) to the intermediate condition (FIG. 7B). Subsequently, the back cushion assembly 30 may be moved from the intermediate condition (FIG. 7B) to the raised condition (FIG. 7A).

The connecting element 38 may have any suitable form. In one embodiment, the connecting element 38 preferably includes a fabric. The fabric preferably is secured to each of the first and second cushions 34, 36, to permit a generally pivoting movement of each relative to the other. Those skilled in the art would be aware of suitable fabrics.

Those skilled in the art would appreciate that the cushions 34, 36 may be of conventional construction, e.g., each of the cushions 34, 36 may include a cover that fits over a resilient back cushion body (not shown) made of a resilient material. For example, the resilient back cushion body may be made of a suitable foam material, or any other suitable material. The cover may be made of any suitable material, such as a suitable fabric. In these circumstances, the connecting element 38 preferably is secured to the respective covers of the cushions 34, 36.

In one embodiment, and as can be seen in FIG. 7D, it is preferred that the back cushion assembly includes a unitary fabric element "R" that includes the connecting element 38 and covers each of the first and second cushions 34, 36. The continuous fabric element "R" preferably also includes the tether element 40.

As can be seen in FIG. 7A, when the back cushion assembly 30 is in the raised condition, the back side 48-1 of the first cushion 34 preferably engages the upper surface 56 of the back support upper element 58 of the housing 50. Preferably, the upper surface 56 is positioned at an angle θ to the horizontal so that the upper surface 56 mates with and engages the back side 48-1 of the first cushion 34, when the back cushion assembly 30 is in the raised condition (FIG. 7C). Also, when the back cushion assembly 30 is in the raised condition, the front side 42-1 of the first cushion 34 mates is substantially parallel with, and partially supports, the back side 48-2 of the second cushion 36.

The first cushion 34 preferably also has a first end side 68-1 and a second end side 70-1, and the second cushion 36 also has a corresponding first end side 68-2 and a second end side 70-2 (FIG. 7B). As can be seen in FIG. 7D, in one embodiment, the connecting element 38 preferably is secured to the first cushion 34 at corner "D" thereof, and the connecting element 38 preferably is also secured to the second cushion 36 at corner "G" thereof. The tether element 40 preferably is secured at one end "Y" thereof, to the second cushion 36 at the corner "H" (FIG. 7D). As can be seen in FIG. 7D, the tether element 40 preferably is secured, at the other end "Z" thereof, to the frame 28, at a location on the frame 28 identified by reference character 71 in FIG. 7D.

As can be seen in FIG. 7A, when the back cushion assembly 30 is in the raised condition, the first end sides 68-1, 68-2 of the first and second cushions 34, 36 respectively preferably are engaged with, and rest upon, the back support cushion 62. As noted above, the back support cushion 62 in turn is supported by the back support lower element 52, which is included in the frame 28 (FIG. 1C).

To move the back cushion assembly 30 from the raised condition to the intermediate condition, the second end sides 70-1, 70-2 of the first and second cushions 34, 36 respectively preferably are pivoted away from the upper surface 56, as indicated by arrow "J" in FIG. 7A. It will be understood that such pivoting movement is generally, but not precisely, about a pivot point located generally between the cushions 34, 36, above the back support cushion 62. It will also be understood that, as the back cushion assembly is pivoted in the direction indicated by arrow "J", the back cushion assembly 30 preferably is also moved generally horizontally away from the back support assembly 22, i.e., in the direction indicated by arrow "K" in FIG. 7A. Those skilled in the art would appreciate that the result of the substantially simultaneous pivoting and horizontal movements of the back cushion assembly 30 is to locate the first end sides 68-1, 68-2 of the cushions 34, 36 a distance "L" apart from the back support lower element 52 of the back support assembly 22 (FIG. 7B), with the back cushion assembly 30 in the intermediate condition.

From the foregoing, it can be seen that the tether element 40 may be folded somewhat, when the back cushion assembly 30 is in the raised condition. It will be understood that the tether element 40 is illustrated in a substantially straight configuration in FIG. 7A for clarity of illustration. Also, the tether element 40 is sufficiently long to permit the back cushion assembly 30 to be moved a distance "L" away from the lower portion 56, when the back cushion assembly 30 is in the intermediate condition.

As can be seen in FIG. 7B, in the intermediate condition, the front side 42-2 of the second cushion 36 is engaged with the top surface 33. Depending on where the back cushion assembly 30 is located relative to the back support assembly 22 when the back cushion assembly 30 is in the intermediate condition, the front side 42-2 of the second cushion 36 may also be partially engaged with and supported by the back support cushion 62.

Preferably, in the intermediate condition, the front side 42-1 of the first cushion 34 engages the back side 48-2 of the second cushion 36. Also, and as can be seen in FIG. 7B, the back cushion assembly 30 is positioned so that the connecting element 38 is located distal to the back support assembly 22.

To move the back cushion assembly from the intermediate condition (FIG. 7B) to the lowered condition thereof (FIGS. 7C, 7D), the first cushion 34 is pivoted outwardly (from the back support assembly 22) relative to the second cushion 36, as indicated by arrow "M" in FIG. 7B. As can be seen in FIGS. 7B and 7C, the first end side 68-1 of the first cushion 34 is pivoted about an axis generally defined by the connecting element 38, to locate the back side 48-1 of the first cushion 34 on the top surface 33 of the body module 32. In the lowered condition, the second end side 70-1 of the first cushion 34 fits against the second end side 70-2 of the second cushion 36. Those skilled in the art would appreciate that, when the first cushion 34 is pivoted outwardly, in moving from the intermediate condition to the lowered condition, the first and second cushions 34, 36 may be moved horizontally.

As noted above, in one embodiment, when the back cushion assembly 30 is first moved to the lowered condition, the first and second cushions 34, 36 preferably are located so that the first end side 68-2 of the second cushion 36 is positioned outside the recess 64. However, when the system 20 is in the sleeping configuration, it is preferred that the first end side 68-2 of the second cushion 36 is located in the recess 64. It will be understood that this may be achieved, after the first cushion 34 has been pivoted relative to the second cushion 36 to engage the back side 48-1 of the first cushion 34 with the top surface 33 (FIG. 1C), by horizontally moving the first and second cushions 34, 36 in the direction indicated by arrow "P" (FIGS. 7C, 7D).

Those skilled in the art would appreciate that the tether element 40 may be folded underneath the second cushion 36, when the first and second cushions 34, 36 are pushed toward the front side 55, i.e., in the direction indicated by arrow "P" in FIGS. 7C and 7D.

It will be understood that, once the back cushion assembly 30 is in the lowered condition with the first end side 68-2 of the second cushion 36 located in the recess 64, bedding (not shown) may be positioned on the back cushion assembly 30, so that a user (not shown) may sleep thereon.

As can be seen, e.g., in FIG. 1C, the back support assembly 22 preferably includes the front side 55 thereof facing toward the one or more body modules 32, and an opposed back side 72 thereof. As noted above, the back support assembly 22 includes the back cover 54 at the back side 72, to at least partially cover the frame 28 (FIG. 1D). It is also preferred that the back cover 54 is openable to provide an opening 76, for permitting access to the frame 28, and a device 78 for closing the opening 76 (FIG. 1D). The device 78 may be any suitable device, e.g., a zipper.

It will be understood that, in FIG. 1D, most parts of the frame 28 are illustrated in dashed lines because those parts are covered by the back cover 54.

It will also be understood that there may be one or more tether elements 40, instead of a continuous tether element 40 extending between the first and second ends 24, 26. The cover 54 preferably is constructed with one or more openings 76 to permit access to the locations on the frame 28 at which the tether elements 40 are respectively secured to the frame 28.

Preferably, the tether element 40 is, via the opening 76, connectable and disconnectable from the frame 28. The end "Y" of the tether element 40 may be connected with the frame 28, at the location 71, in any suitable manner, with any suitable means. However, as will be described, it is preferred that the end "Y" is readily disconnectable from the frame 28, to facilitate the removal of the back cushion assembly 30, e.g., if the back cushion assembly 30 is to be cleaned, or repaired, or replaced.

From the foregoing, it can be seen that the user (not shown) may easily obtain access to the frame 28, and therefore also access to the one or more ends "Y" of the one or more tether elements 40 that are connected with the frame 28, via the one or more openings 76. For instance, if the opening 76 is closed by a zipper device, then the opening may easily be opened, by moving the zipper, as is well known in the art. The user may then easily disconnect the respective ends "Y" of the one or more tether elements 40 from the frame 28, to permit removal of the back cushion assembly 30.

The cleaned back cushion assembly 30 (or a replacement, as the case may be) may be readily installed, by securing the one or more tether elements 40 to the frame 28, via the one or more openings 76. Once the one or more tether elements 40 are so secured, the openings 76 are closed, by the device 78.

It can be seen that the system 20 has a number of advantages over the prior art. First, because the back cushion assembly 30 is not connected with the frame by a hinge assembly, manufacturing costs are reduced, and the unit's overall weight is less. Second, because the back cushion assembly 30 can easily be removed from the frame 28, the cost and difficulty involved in cleaning or repairing or replacing the back cushion assembly 30 is less than would be involved in connection with cleaning or repairing or replacing corresponding elements in the prior art units.

It will be understood that the convertible sofa bed system 20 may include any suitable number of the body modules 32. As can be seen, for example, in FIG. 1A, the convertible sofa bed system 20 may include three body modules 32, respectively identified in FIG. 1A for clarity of illustration by reference characters 32S, 32T, and 32U. In one embodiment, the convertible sofa bed system 20 preferably includes first and second end body modules 32S, 32U that are located proximal to the first and second ends 24, 26 of the back support assembly 22 respectively. The system 20 preferably also includes a center body module 32T located between the first and second end body modules 32S, 32U.

As can be seen in FIG. 1A, for clarity of illustration, the top surfaces of the body modules 32S-32U are identified by reference characters 33S-33U respectively.

Figure 5:
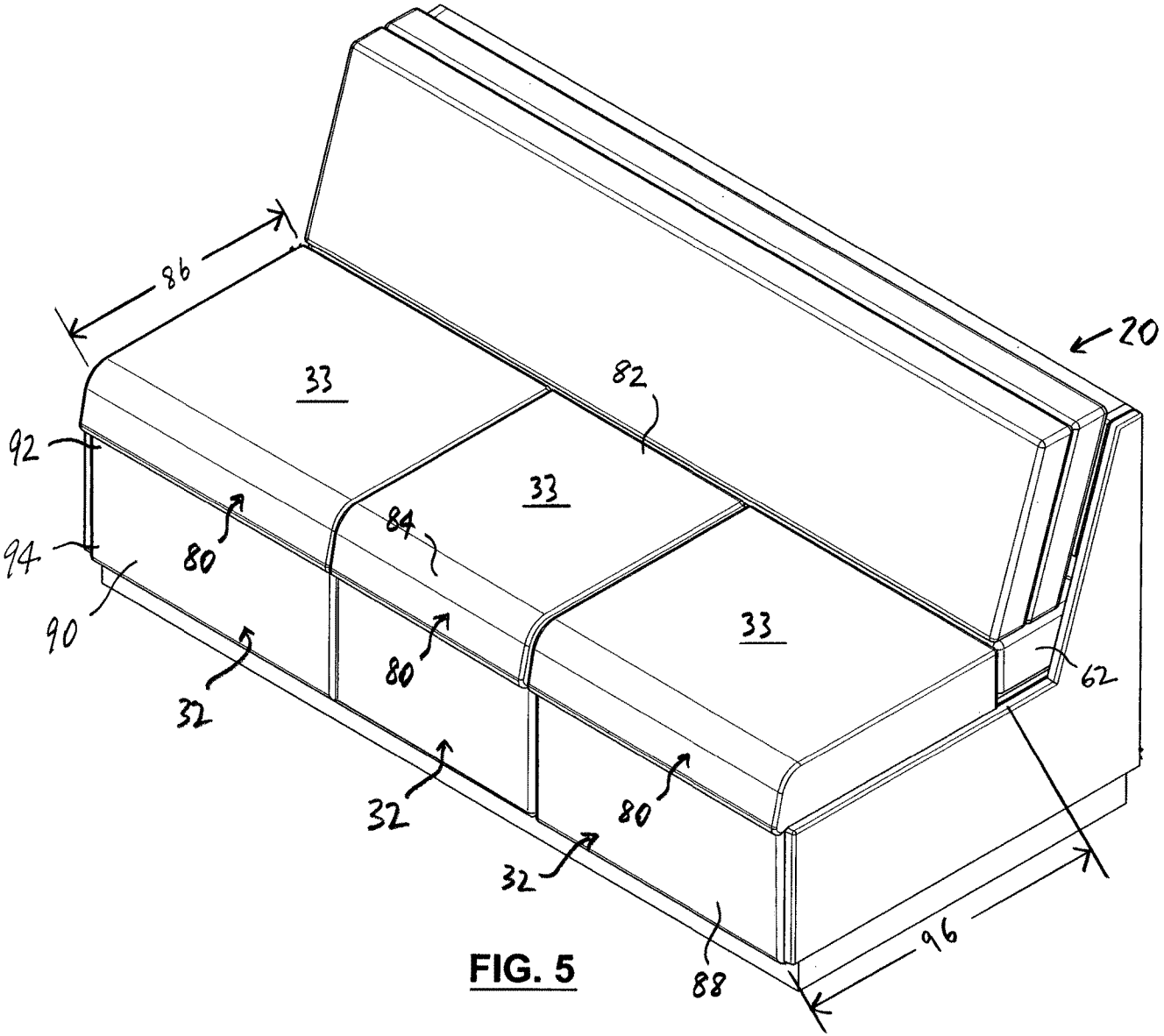
FIG. 5 is an isometric view of another alternative embodiment of the convertible sofa bed system of the invention that includes a storage compartment with a seat cushion thereof in a lowered position.

Those skilled in the art would appreciate that the body modules 32 may have different attributes, or features, as desired. For example, in one embodiment illustrated in FIGS. 5-6, each of the body modules 32 preferably includes a seat cushion 80 that includes the at least partially planar top surface 33. Preferably, the seat cushion 80 extends between an inner side 82 thereof that is located proximal to the front side of the back support cushion 62, and an outer side 84 thereof that is spaced apart from the front side 55 of the back support cushion 62 by a first predetermined distance 86 (FIG. 5). The body module 32 preferably also includes a base 88 comprising a front panel 90 extending between upper and lower ends 92, 94 thereof and located at a second predetermined distance 96 from the front side 55 of the back support cushion 62 (FIG. 5).

It will be understood that the second predetermined distance 96 may be less than, or greater than, or equal to, the first predetermined distance 86.

Figure 6:
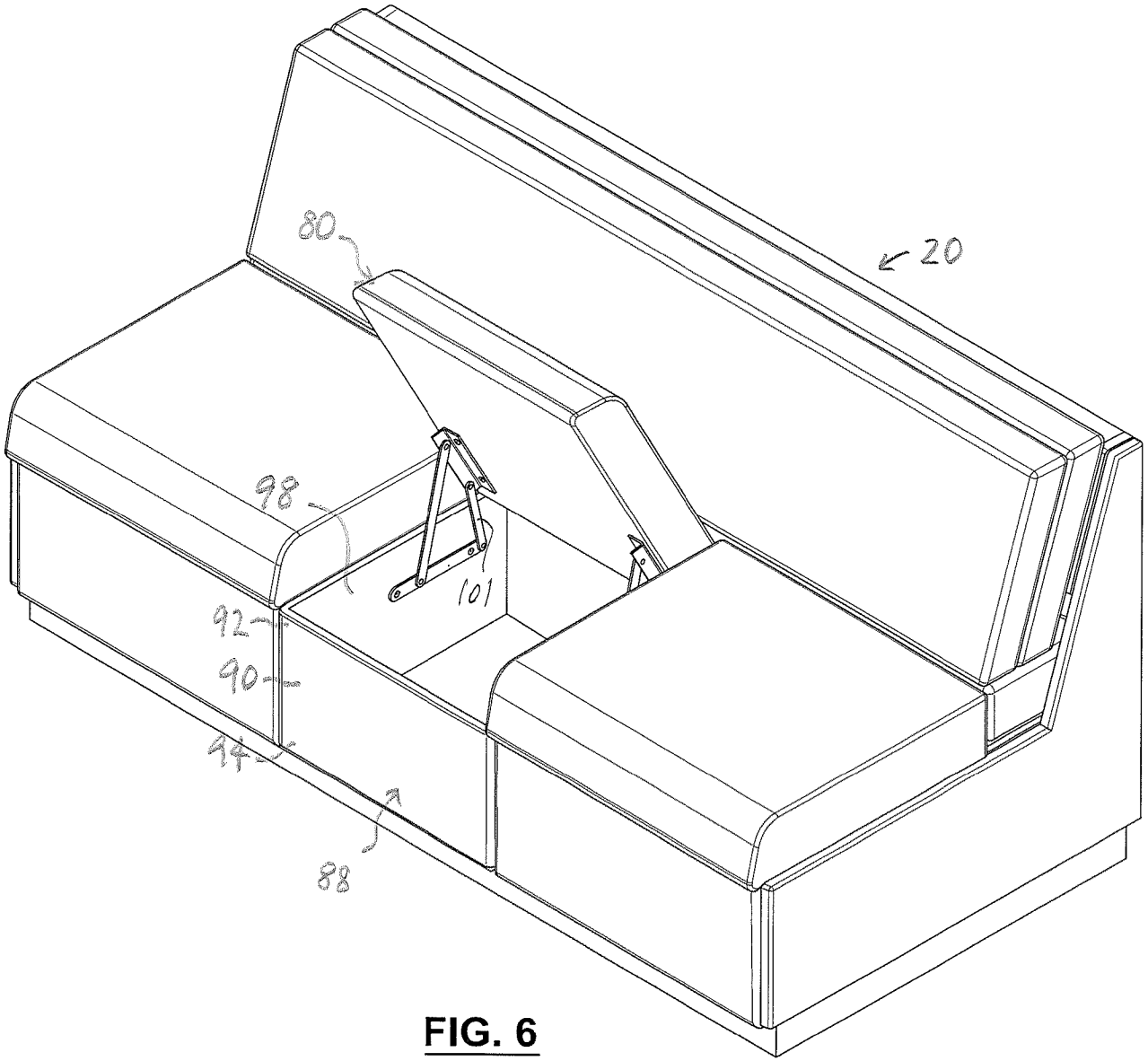
FIG. 6 is an isometric view of another embodiment of the convertible sofa bed of FIG. 5 in which the seat cushion of the body module including a seat and storage compartment is illustrated in a raised position.

In one embodiment, the base 88 preferably defines a storage compartment 98 therein (FIG. 6). As can be seen in FIGS. 5 and 6, the seat cushion 80 preferably is movable between a closed position thereof (FIG. 5), in which the at least partially planar top surface 33 is positioned substantially horizontally and the outer side 84 is located proximal to the upper end 92 of the front panel 90, and an open position thereof (FIG. 6), in which the outer side 84 of the seat cushion 80 is spaced apart from the upper end 92 of the front panel 90, to provide access to the storage compartment 98.

As can be seen in FIG. 6, it is also preferred that the body module 32 additionally includes one or more pivoting subassemblies 101 connecting the seat cushion 80 with the base 88, to permit the seat cushion 80 to pivot between the closed and open positions thereof. Those skilled in the art would be aware of suitable pivoting subassemblies 101.

In another embodiment, illustrated in FIGS. 1A, 1B, 2A, and 2B, the center body module 32T preferably includes a table element 103 comprising the at least partially planar top surface 33 thereof, and a table support subassembly 105 supporting the table element 103 (FIG. 1B). The table support subassembly 105 preferably is configured to move the table element 103 between a lowered position (FIGS. 1A, 1B), in which the at least partially planar top surface 33 of the table element 103 is aligned with the at least partially planar top surfaces 33 of the first and second end body modules 32S, 32U (FIG. 1A), and a raised position (FIGS. 2A, 2B), in which the at least partially planar top surface 33 of the table element 103 is located at a selected elevation 106 above the at least partially planar top surfaces 33 of the first and second end body modules 32S, 32U.

Figure 3:
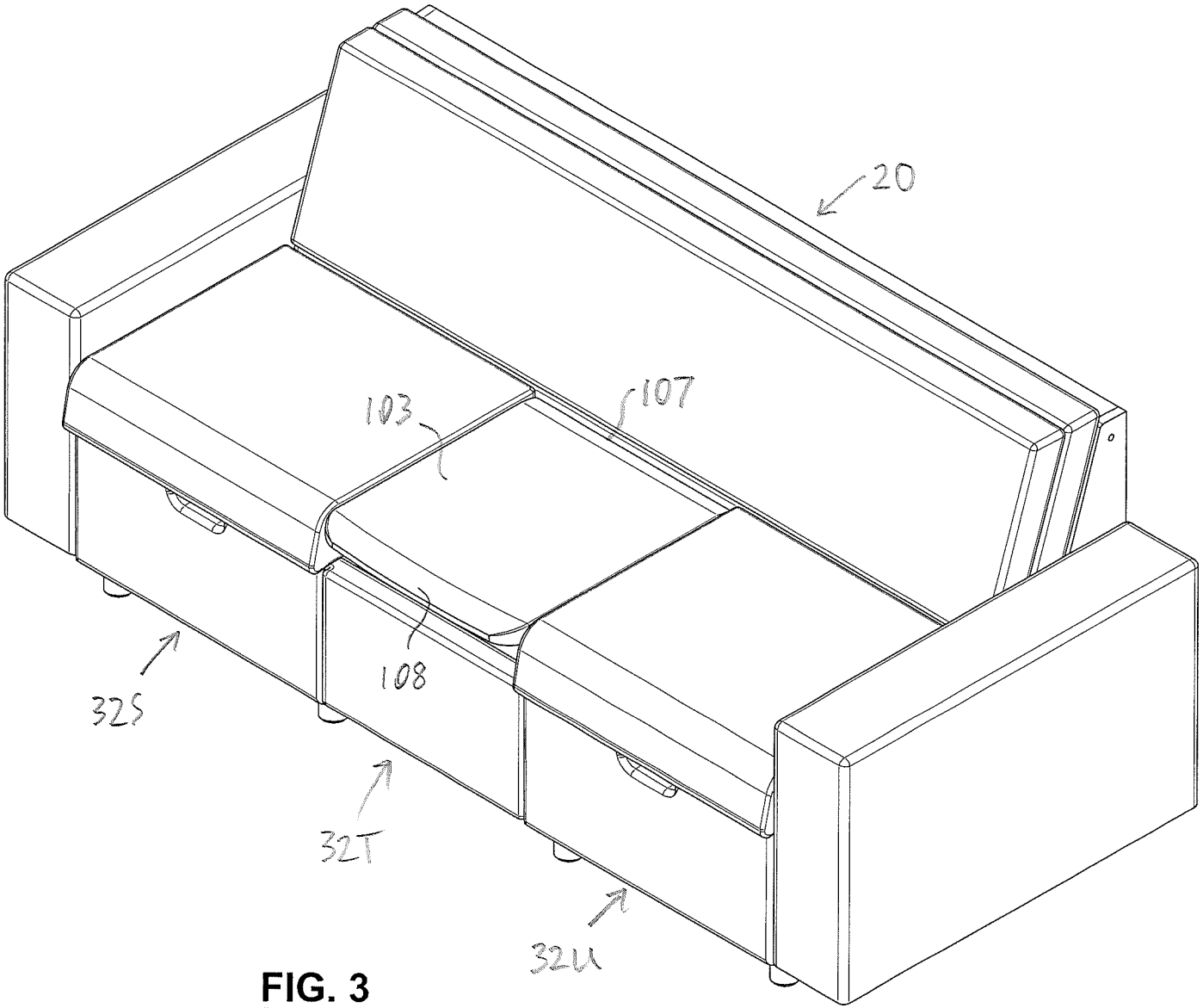
FIG. 3 is an isometric view of another alternative embodiment of the convertible sofa bed system of the invention that includes a central body module including a fixed height table, with a table element thereof in a lowered position and a body module including seat and storage compartment, with a seat cushion thereof in a lowered position.
Figure 4A:
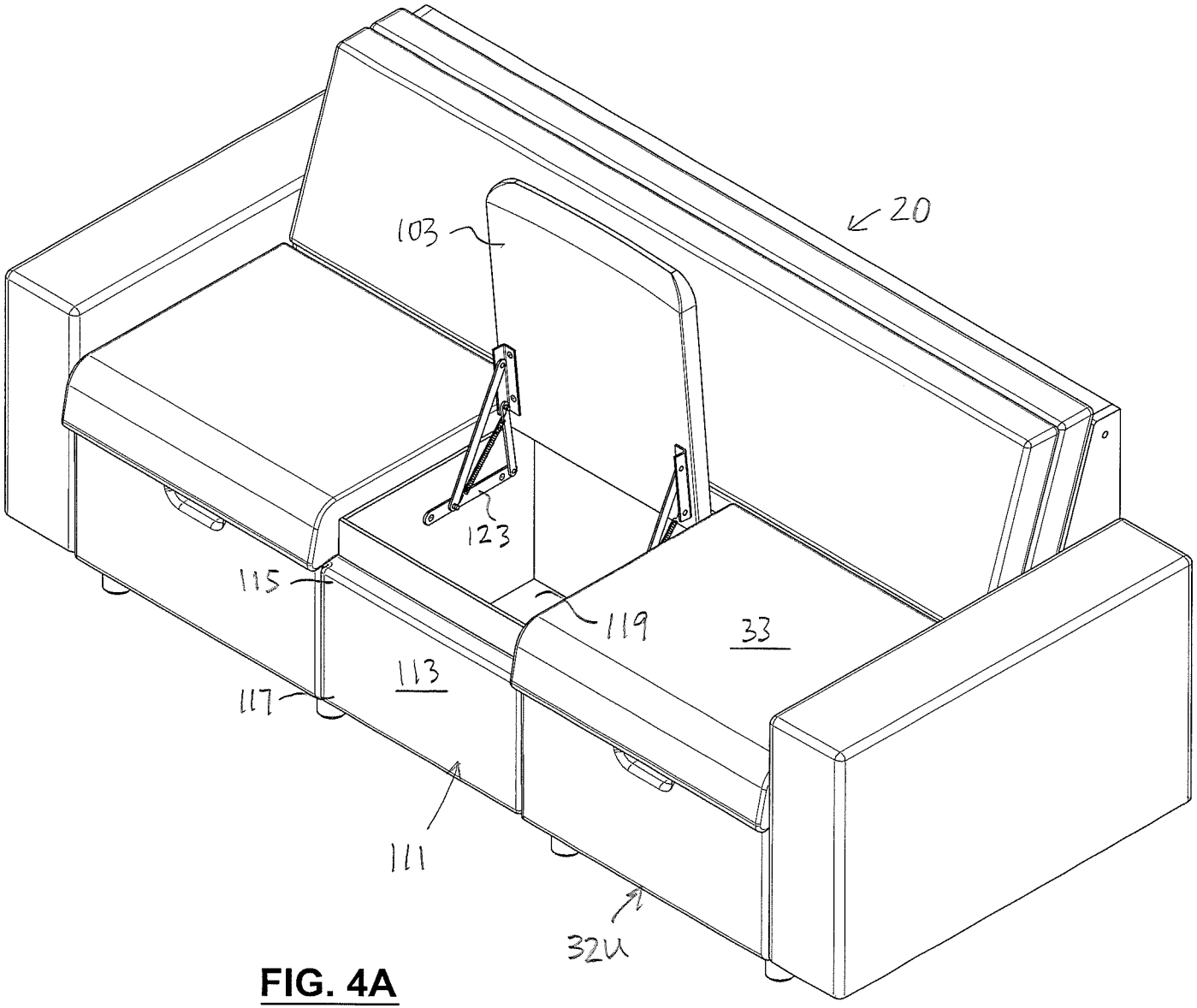
FIG. 4A is an isometric view of the convertible sofa bed system of FIG. 3 in which the table element of the central module is illustrated in a raised position thereof.
Figure 4B:
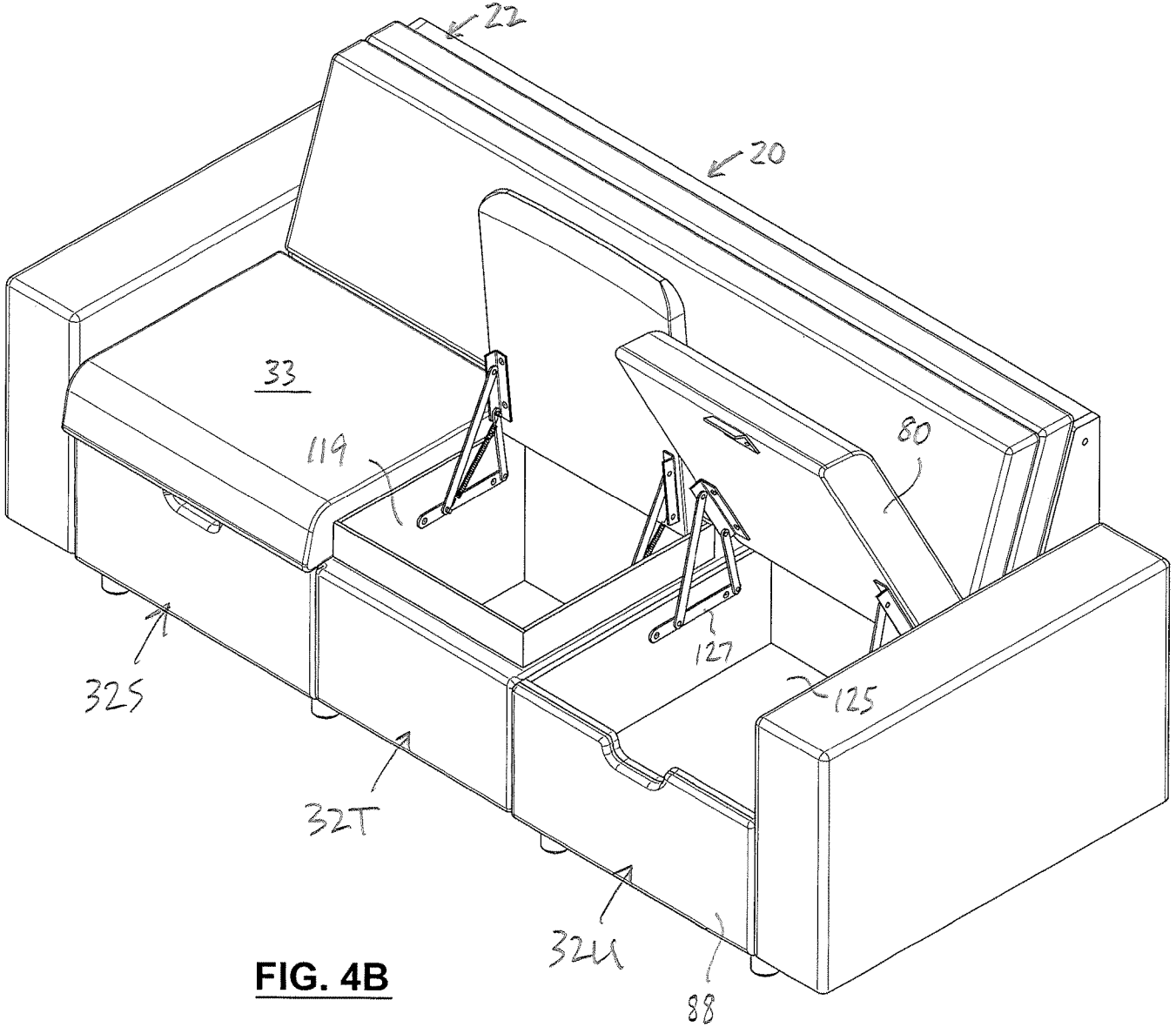
FIG. 4B is an isometric view of the convertible sofa bed system of FIG. 4A in which the seat cushion of one of the end body modules is in a raised position.

In another alternative embodiment, illustrated in FIGS. 3-4B, the center body module 32T preferably includes the table element 103 extending between an inner end 107 thereof located proximal to the front side of the back support assembly 22 (not shown in FIG. 3), and an outer end 108 that is spaced apart from the inner end 107 by a preselected distance 109. It is also preferred that the convertible sofa bed system 20 includes a center base 111 having a center front panel 113 extending between upper and lower ends 115, 117 thereof and spaced apart from the front side of the back support assembly 22. As can be seen in FIG. 4A, the central base 111 defines a central storage space 119 therein. Preferably, the convertible sofa bed system 20 also includes one or more hinge subassemblies 123 connecting the table element 103 with the center base 111, to permit the table element 103 to pivot between an open position (FIGS. 4A, 4B), in which the central storage space 119 is accessible, and a closed position (FIG. 3), in which the central storage space 119 is inaccessible.

It will also be understood that the end modules 32S, 32U may, optionally, include different elements, and features. For example, as illustrated in FIGS. 3-4B, the end module 32U preferably includes the seat cushion 80, and the base 88. The base 88 preferably defines a storage space 125 therein (FIG. 4B). The seat cushion 80 is pivotable between an open position (FIG. 4B), in which the storage space 125 is accessible, and a closed position (FIGS. 3, 4A), in which the top surface 33 of the cushion 80 is positioned substantially horizontal. The seat cushion 80 preferably is connected to the base 88 by one or more hinge subassemblies 127 (FIG. 4B).

It will be understood that, alternatively, one or both of the end modules 32S, 32U may include a footrest assembly 129. For example, as illustrated in FIGS. 1A, 1B, 2A, and 2B, the first end module 32S includes the footrest assembly 129. The footrest assembly 129 is movable between an extended condition (FIGS. 2A, 2B) and a collapsed condition (FIGS. 1A, 1B), in which the footrest assembly 129 is folded underneath the seat cushion 80 of the first end module 32S. Those skilled in the art would be aware of suitable footrest assemblies.

Figure 8A:
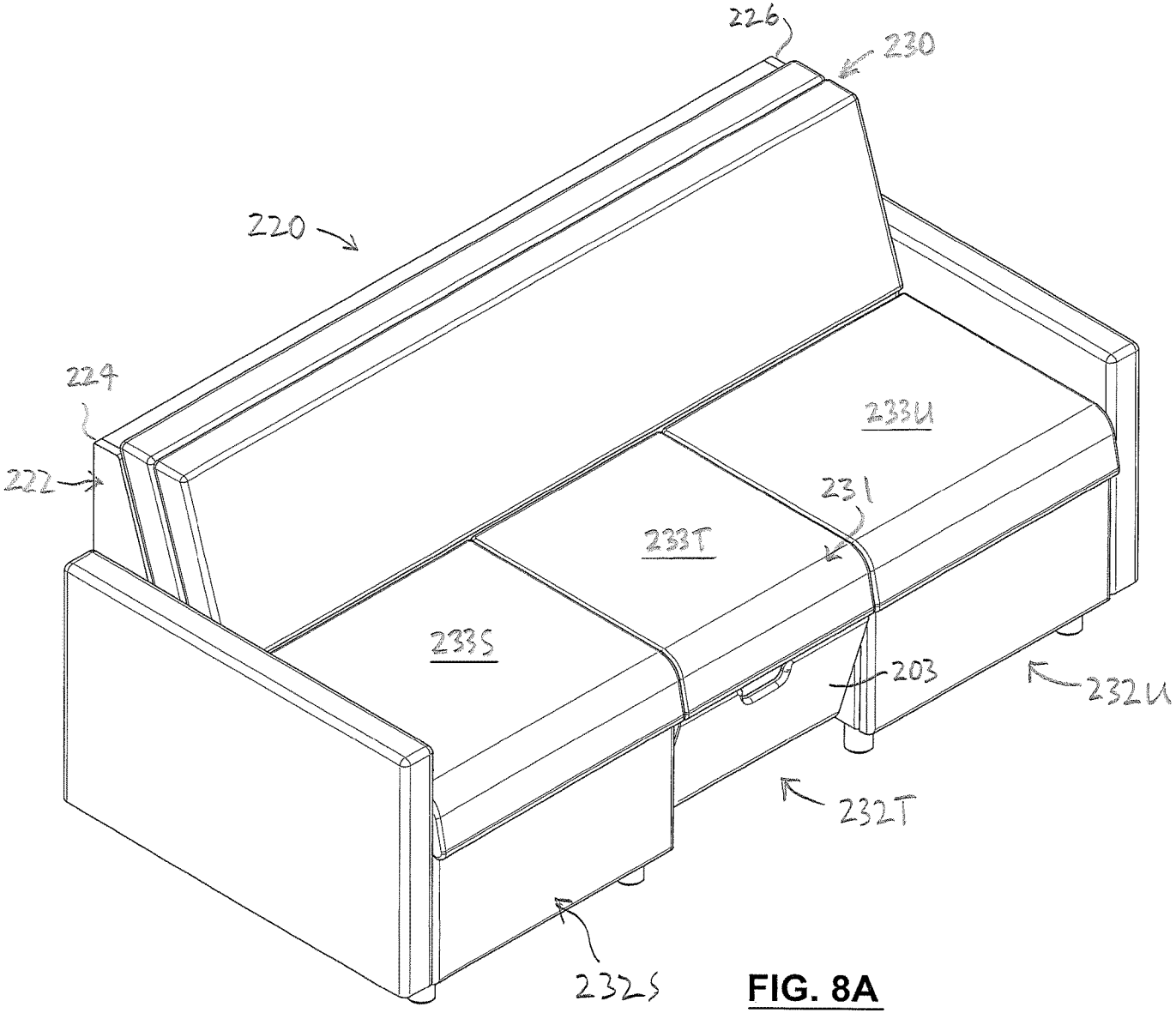
FIG. 8A is an isometric view of another alternative embodiment of the convertible sofa bed system of the invention including a central body module with a central seat cushion subassembly in a first position thereof, the convertible sofa bed system being shown in a seating configuration thereof.
Figure 8B:
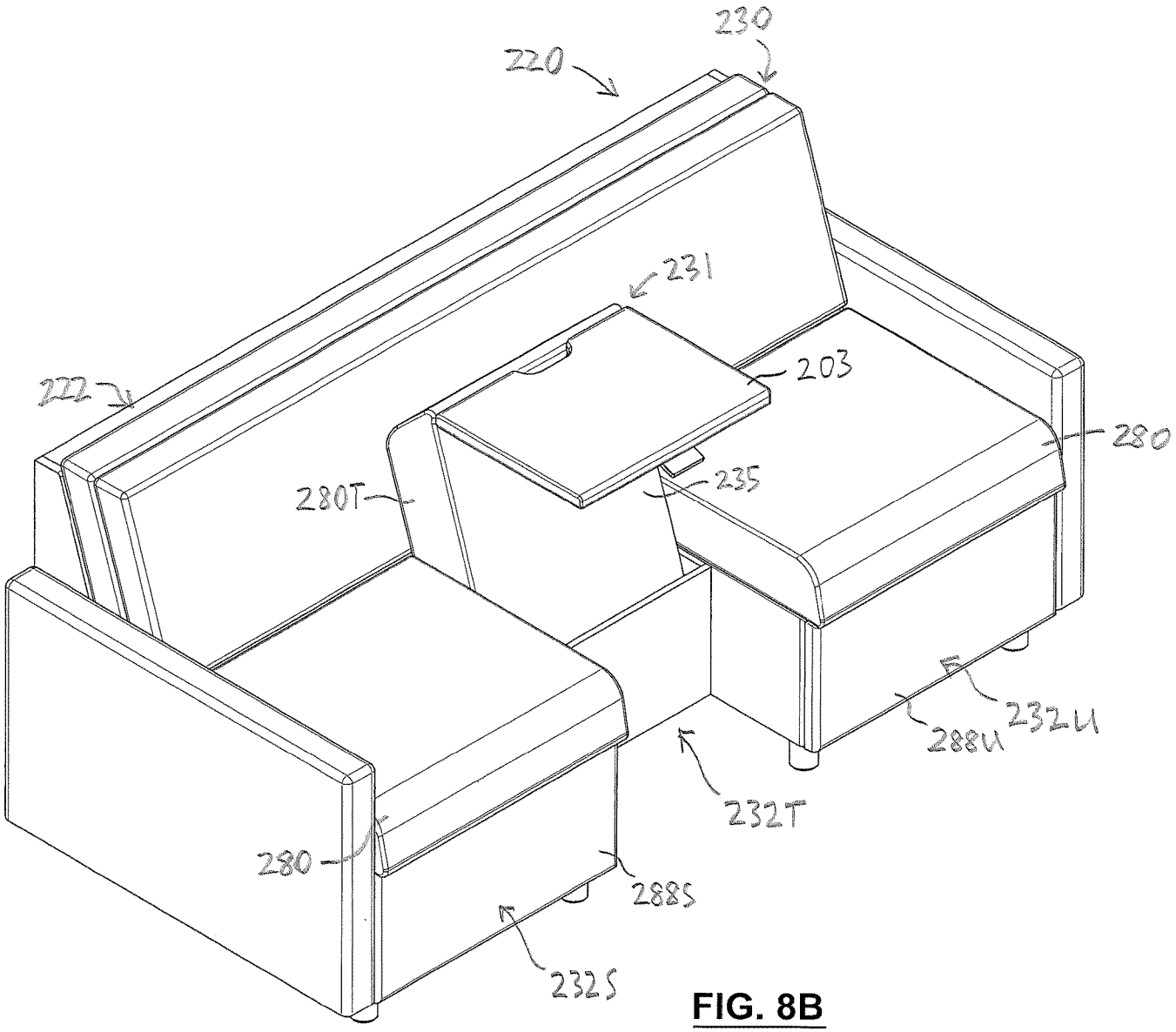
FIG. 8B is an isometric view of the convertible sofa bed system of FIG. 8A in which the central seat cushion subassembly is in a second position thereof.

An alternative embodiment of the convertible sofa bed system 220 of the invention is illustrated in FIGS. 8A-9F. Preferably, the convertible sofa bed system 220 includes a back support assembly 222 and a frame element 228 having a front side and an opposed back side 272 thereof (FIGS. 9C, 9D). The back support assembly 222 extends between first and second ends 224, 226 thereof. The back support assembly preferably includes the frame element 228 (FIGS. 9C, 9D). As can be seen in FIG. 8A, the convertible sofa bed system 220 preferably includes a number of body modules 232 that are secured to a frame of the system 220 (FIGS. 8A, 8B). Preferably, the body modules include first and second body modules 232S, 232U located proximal to the first and second ends 224, 226 respectively, and a central body module 232T located between the first and second ends 224, 226 (FIG. 8B). The body modules 232S, 232U respectively include first and second at least partially planar top surfaces 233S, 233U, and an at least partially planar central top surface 233T (FIG. 8A).

Figure 8C:
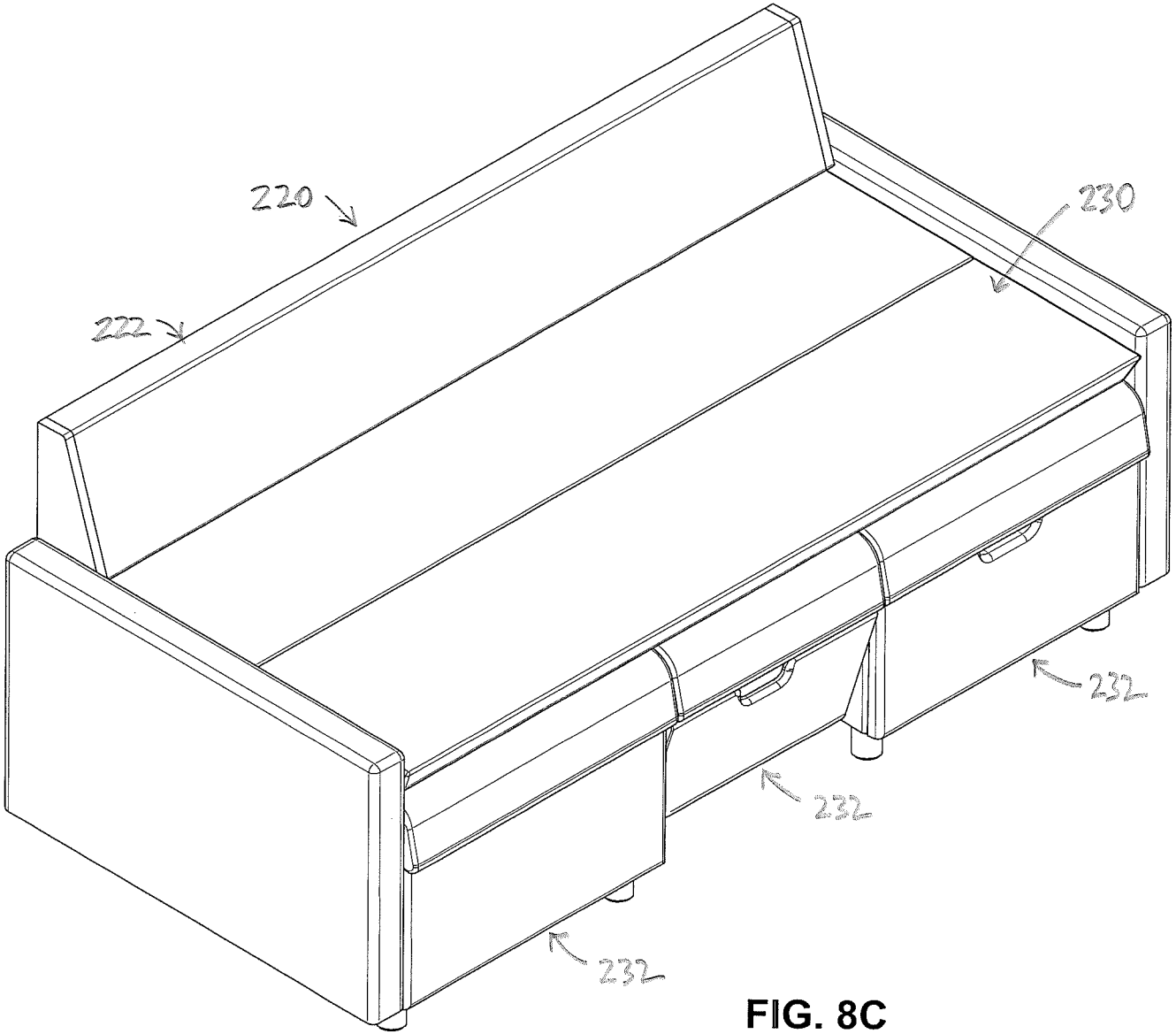
FIG. 8C is an isometric view of the convertible sofa bed system of FIG. 8A in which the convertible sofa bed system is in a sleeping configuration thereof.

The convertible sofa system 220 preferably also includes a back cushion assembly 230 movable between a raised condition (FIG. 8A) and a lowered condition (FIG. 8C). The convertible sofa system 220 is shown in a seating configuration thereof in FIG. 8A, and in a sleeping configuration thereof in FIG. 8C.

Preferably, the first and second body modules 232S, 232U include first and second bases 288S, 288U respectively. The first and second bases 288S, 288U at least partially support first and second seat cushions 280 having first and second at least partially planar top surfaces 233S, 233U respectively. It is also preferred that the center body module 232T includes a central seat cushion subassembly 231 including a central cushion 280T having an at least partially planar central top surface 233T and an opposed central bottom surface 235.

Figure 9B:
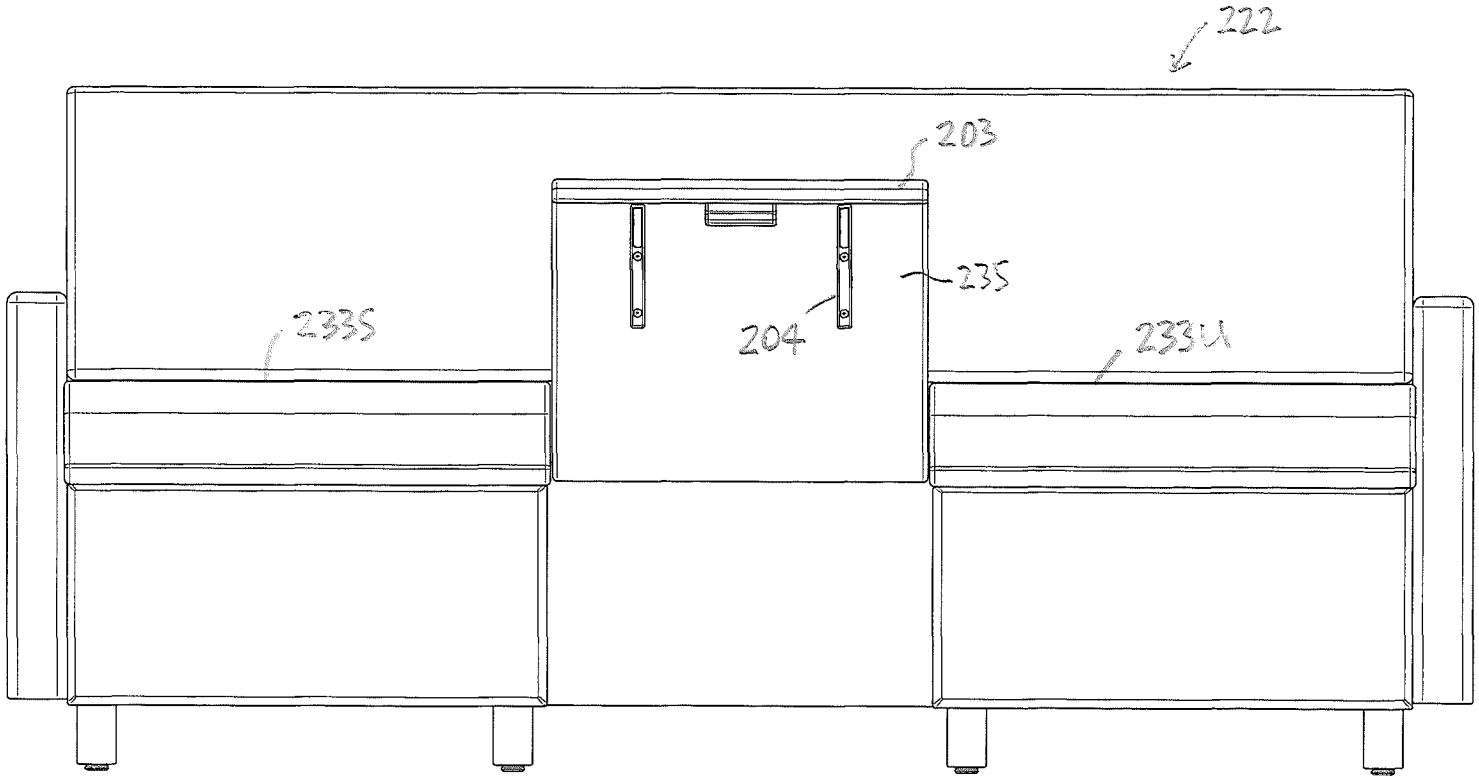
FIG. 9B is a front view of the convertible sofa bed system of FIG. 8B.
Figure 9C:
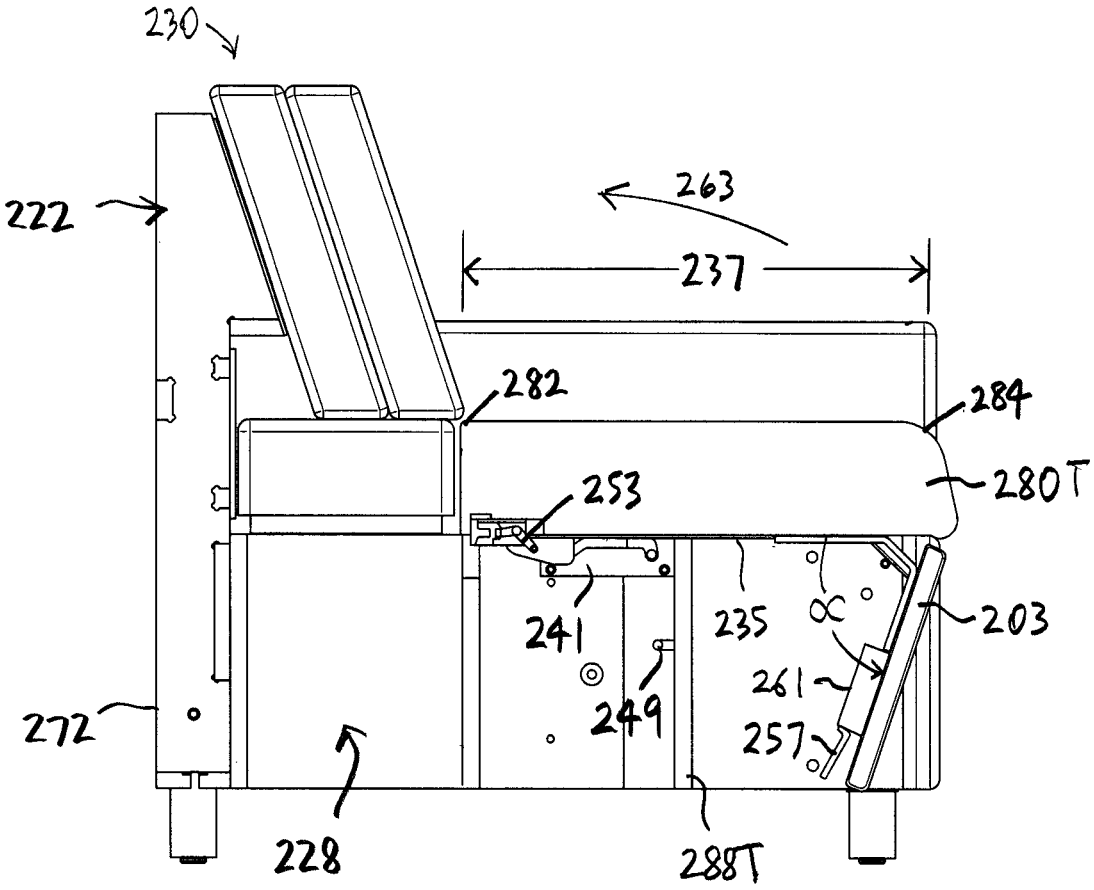
FIG. 9C is a partial cross-section of the convertible sofa bed system of FIGS. 8A and 9A, in which the central seat cushion subassembly is in the first position thereof.

As can be seen in FIG. 9C, the central seat cushion subassembly 231 extends between an inner side 282 thereof that is located proximal to the front side of the back support assembly 222, and an outer side 284 thereof that is spaced apart from the front side of the frame element 228 by a predetermined distance 237.

It is also preferred that the center body module 232T includes a table element 203 and a connecting assembly 239. The table element 203 is connected to the central seat cushion subassembly 231 at the outer side 284 thereof. The table element 203 preferably is located relative to the at least partially planar central bottom surface 235 to define a predetermined angle cc therebetween (FIG. 9C). The table element 203 preferably is secured to the back 235 by brackets 204 (FIG. 9E).

The connecting assembly 239 connects the central seat cushion subassembly 231 to the first and second bases 288S, 288U, for pivoting movement of the central seat cushion subassembly 231 between a first position (FIGS. 8A, 8C, 9A, 9C, 9F), in which the at least partially planar top surface 233T of the central cushion 280T is aligned with the first and second at least partially planar central top surfaces 233S, 233U of the respective first and second body modules 232S, 232U, and a second position (FIGS. 8B, 9B, 9D, 9E), in which the seat cushion subassembly 231 is positioned to locate the table element 203 in a substantially horizontal position.

Figure 9D:
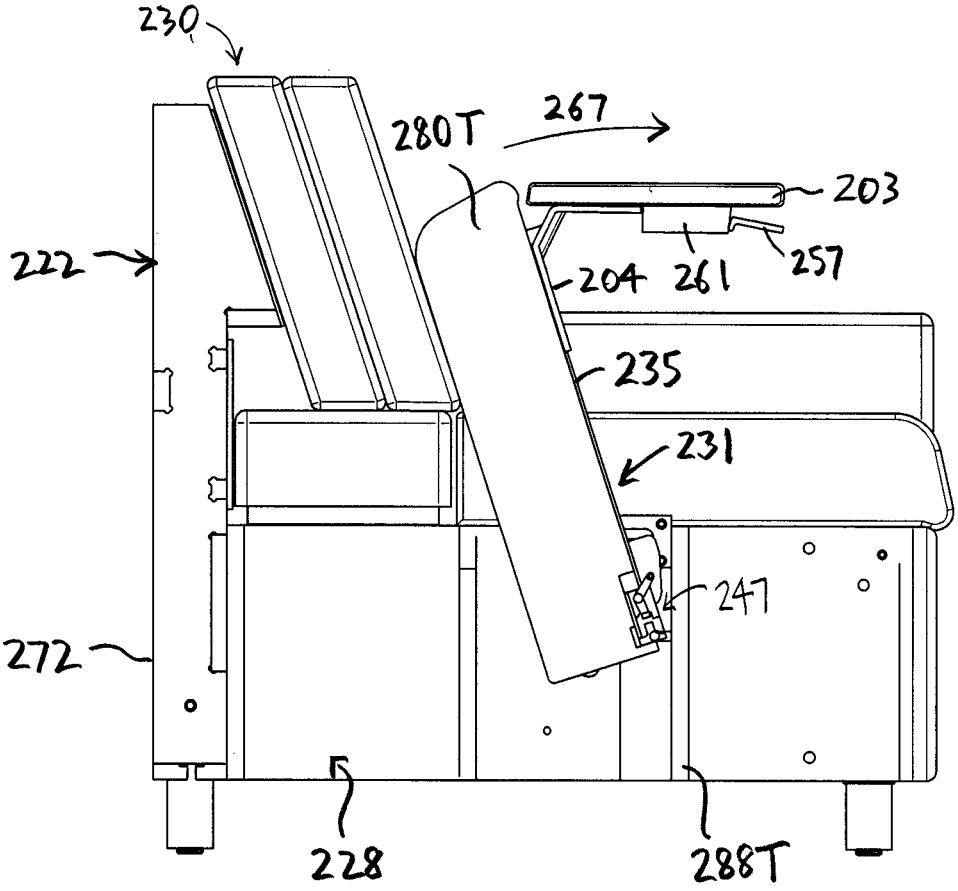
FIG. 9D is a partial cross-section of the convertible sofa bed system of FIGS. 8B and 9B, in which the central seat cushion subassembly is in the second position thereof.
Figure 9E:
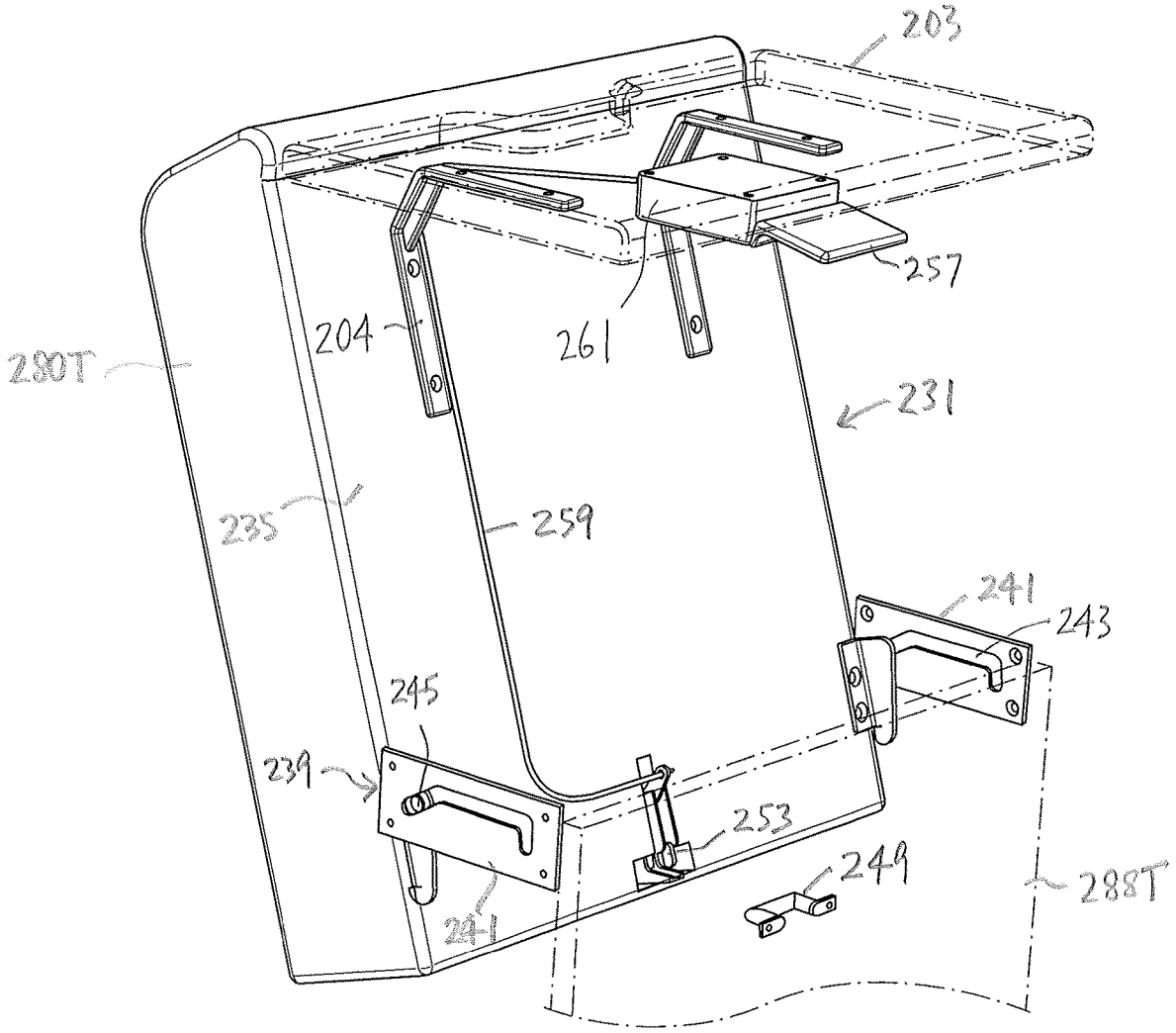
FIG. 9E is an isometric view of the central seat cushion subassembly in the second position thereof, with portions thereof shown in ghost outline, drawn at a larger scale.
Figure 9F:
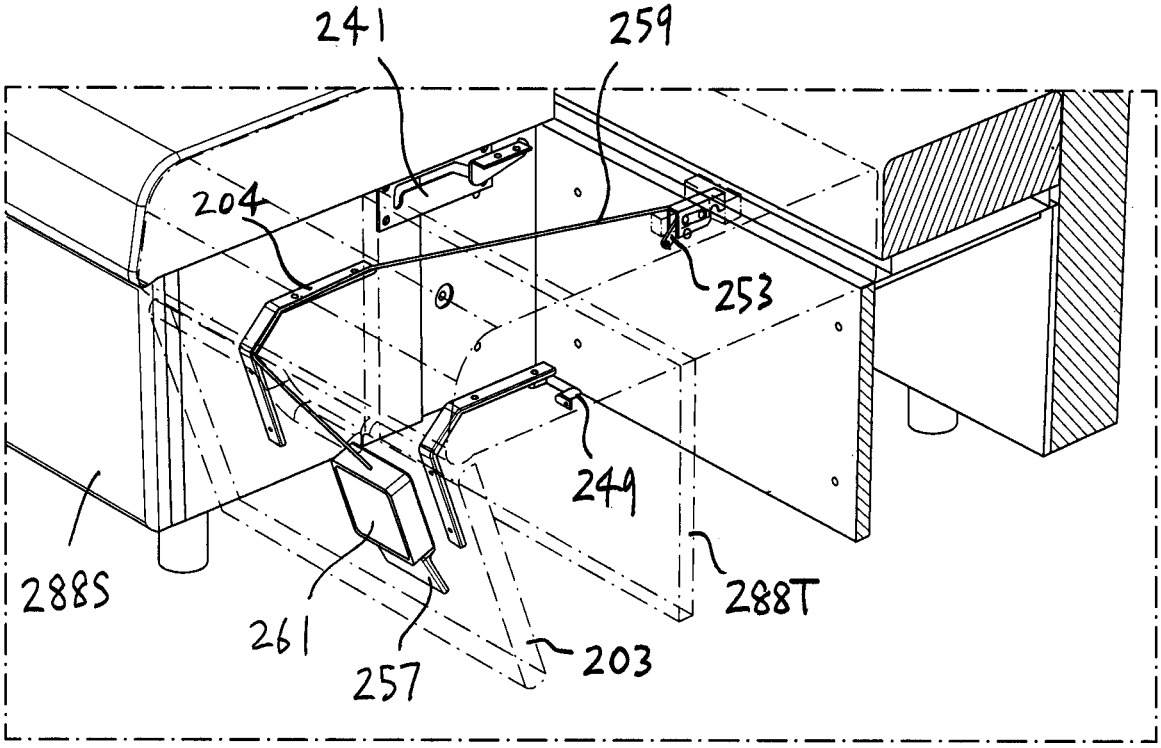
FIG. 9F is an isometric view of the central seat cushion subassembly in the first position thereof, with portions thereof shown in ghost outline.

The connecting assembly 239 preferably includes one or more guide plates 241 mounted on at least a selected one of the first and second bases 288S, 288U (FIGS. 9E, 9F). The guide plate 241 preferably includes a slot 243 therein (FIG. 9E). It is also preferred that the connecting assembly 239 includes one or more rods 245 mounted to the central seat cushion subassembly 231. The rod 245 preferably is partially positioned into the slot 243. The rod 245 moves along the slot 243 as the central seat cushion subassembly 231 moves between the first and second positions, to guide the central seat cushion 280T therebetween.

It will be understood that the two plates 241 illustrated in FIG. 9E are mounted to the bases 288S, 288U respectively.

It is preferred that the center body module 232T includes a central base 288T positioned to support the central seat cushion subassembly 231, when the central seat cushion subassembly 231 is in the first position thereof. The central body module 232T preferably also includes a latch subassembly 247 (FIG. 9D). Preferably, the latch subassembly 247 includes a catch element 249 mounted on a front panel 251 of the central base 288T, and a latch element 253 positioned on the central bottom surface 235 for engagement with the catch element 249 when the central seat cushion subassembly 231 is in the second position, whereby the central seat cushion subassembly 231 is thereby held in the second position.

The latch subassembly 247 preferably also includes a release lever 257, and a cable 259 extending between the release lever 257 and the latch element 253. The release lever 257 preferably is movable between an actuating position, in which the release lever 257 pulls the cable 259, to disengage the latch element 253 from the catch element 249, and a non-actuating position, in which the release lever 257 does not pull the cable 259.

It will be understood that the central seat cushion subassembly 231 is held in the first position under the influence of gravity. As can be seen in FIGS. 9C and 9F, when the central seat cushion subassembly 231 is in the first position, it is supported by the central base 288T.

It will also be understood that, in FIG. 9E, the latch element 253 is not shown engaging the catch element 249 for clarity of illustration. Preferably, the release lever 257 is mounted in a housing 261 and pivots between an activated position, in which the cable 259 is pulled, and a rest position, in which the cable 259 is not pulled. The release lever 257 is biased to the rest position by one or more suitable biasing elements (not shown) located in the housing 261.

When the central seat cushion subassembly 231 is moved from the first position to the second position, the outer end 284 pivots first upwardly, and then generally toward the back cushion assembly 230 as indicated by arrow 263 in FIG. 9C. The latch element 253 engages the catch element 249 (FIG. 9D), to hold the central seat cushion subassembly 231 in the second position. To release the latch element 253 from the catch element 249, the release lever 257 is moved to the activated position, thereby subjecting the cable 259 to tension, to pull the latch element 253 from the catch element 249. The central seat cushion subassembly 231 is then pivoted (as indicated by arrow 267 in FIG. 9D) from the second position to the first position.

In use, the body modules to be included in the convertible sofa bed system may be selected as desired during manufacturing. The standardization of dimensions of the body modules permits various modules to be selected for use together (i.e., the end modules have the same overall dimensions). In each case, the body modules are selected according to the user's requirements, and cost benefits result from the standardization of the body modules. The system is readily converted from the seating configuration to the sleep configuration, and vice versa.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A convertible sofa bed system positionable on a floor, the convertible sofa bed system comprising:

a back support assembly extending between first and second ends thereof, the back support assembly comprising a frame;

at least one back cushion assembly movable between a raised condition and a lowered condition thereof, said at least one back cushion assembly comprising:

a first cushion;

a second cushion;

at least one connecting element, connecting the first and second cushions;

when said at least one back cushion assembly is in the raised condition, the first cushion engages the back support assembly, and the second cushion is partially supported by the first cushion;

at least one body module secured to the frame, said at least one body module comprising at least one seat cushion comprising at least one at least partially planar top surface positionable at a predetermined elevation above the floor;

said at least one body module being formed to cooperate with said at least one back cushion assembly in the raised condition to define a seating configuration;

said at least one body module being formed to cooperate with said at least one back cushion assembly in the lowered condition to define a sleeping configuration, wherein, when said at least one back cushion assembly is in the lowered condition, the first and second cushions engage said at least one at least partially planar top surface of said at least one body module;

the back support assembly comprises:

a front side thereof facing toward said at least one body module;

an opposed back side thereof;

said at least one seat cushion extending between an inner side thereof that is located proximal to the front side of the back support assembly, and an outer side thereof that is spaced apart from the front side of the back support assembly by a first predetermined distance;

the back support assembly comprises a back cover at the back side, to at least partially cover the frame; and the front side of the back support assembly being formed to define a recess therein into which a portion of the second cushion is receivable, when said at least one back cushion assembly is in the lowered condition thereof, to locate a front side of the first cushion proximal to the outer side of said at least one seat cushion of said at least one body module.

2. The convertible sofa bed system according to claim 1 in which said at least one back cushion assembly is connected with the frame by at least one tether element, for limiting the movement of said at least one back cushion assembly away from the back support assembly.

3. The convertible sofa bed system according to claim 2 in which the back cover is openable to provide an opening that permits access to the frame and the back cover comprises a device for closing the opening.

4. The convertible sofa bed system according to claim 3 in which said at least one tether element is, via the opening in the back cover, connectable to, and disconnectable from the frame.

5. The convertible sofa bed system according to claim 1 in which said at least one body module comprises:

a base comprising a front panel extending between upper and lower ends thereof and located at a second predetermined distance from the front side of the back support assembly, the base defining a storage space therein; and the seat cushion being movable between a closed position thereof, in which said at least one at least partially planar top surface is positioned substantially horizontally and the outer side is located proximal to the upper end of the front panel, and an open position thereof, in which the outer side of the seat cushion is spaced apart from the upper end of the front panel, to provide access to the storage space.

6. The convertible sofa bed system according to claim 5 in which said at least one body module additionally comprises at least one pivoting subassembly connecting the seat cushion with the base, to permit the seat cushion to pivot between the closed and open positions thereof.

7. The convertible sofa bed system according to claim 6 in which said at least one body module comprises:

first and second end body modules that are located proximal to the first and second ends of the back support assembly respectively; and a center body module located between the first and second end body modules.

8. The convertible sofa bed system according to claim 7 in which the center body module comprises:

a table element extending between an inner end thereof located proximal to the front side of the back support assembly, and an outer end that is spaced apart from the inner end by a preselected distance;

a center base comprising a center front panel extending between upper and lower ends thereof and spaced apart from the front side of the back support assembly, the central base defining a central storage space therein; and at least one hinge subassembly connecting the table element with the center base, to permit the table element to pivot between an open position, in which the central storage space is accessible, and a closed position, in which the central storage space is inaccessible.

9. A convertible sofa bed system positionable on a floor, the convertible sofa bed system comprising:

a back support assembly having a front side and an opposed back side thereof, the back support assembly extending between first and second ends thereof, and the back support assembly comprising a frame;

at least one back cushion assembly movable between a raised condition and a lowered condition thereof, said at least one back cushion assembly comprising: a first cushion; a second cushion; at least one connecting element, connecting the first and second cushions; when said at least one back cushion assembly is in the raised condition, the first cushion engages the back support assembly, and the second cushion is partially supported by the first cushion;

a plurality of body modules secured to the frame, the body modules comprising:

first and second body modules located proximal to the first and second ends respectively;

a central body module located between the first and second ends, said body modules respectively comprising first and second at least partially planar top surfaces, and a central at least partially planar top surface;

the first and second body modules comprising first and second bases respectively, said first and second bases at least partially supporting the first and second at least partially planar top surfaces respectively;

the center body module comprising:

a central seat cushion subassembly comprising a central cushion comprising the at least partially planar central top surface and an opposed at least partially planar central bottom surface, the central seat cushion subassembly extending between an inner side thereof that is located proximal to the front side of the back support assembly, and an outer side thereof that is spaced apart from the front side of the back support assembly by a first predetermined distance;

a table element connected to the central seat cushion subassembly at the outer side thereof, the table element being located relative to the at least partially planar central bottom surface to define a predetermined angle therebetween; and a connecting assembly connecting the central seat cushion subassembly to the first and second bases, for pivoting movement of the central seat cushion subassembly between a first position, in which the at least partially planar top surface of the central cushion is aligned with the first and second at least partially planar central top surfaces of the respective first and second body modules, and a second position, in which the central seat cushion subassembly is positioned to locate the table element in a substantially horizontal position, wherein, when said at least one back cushion assembly is in the lowered condition, the first and second cushions engage said at least one at least partially planar top surface of said at least one center body module;

the back support assembly comprises:

a front side thereof facing toward said at least one body module;

an opposed back side thereof;

said at least one central seat cushion subassembly extending between an inner side thereof that is located proximal to the front side of the back support assembly, and an outer side thereof that is spaced apart from the front side of the back support assembly by a first predetermined distance;

the back support assembly comprises a back cover at the back side, to at least partially cover the frame;

and the front side of the back support assembly being formed to define a recess therein into which a portion of the second cushion is receivable, when said at least one back cushion assembly is in the lowered condition thereof, to locate a front side of the first cushion proximal to the outer side of said at least one central seat cushion subassembly of said at least one body module.

10. The convertible sofa bed system according to claim 9 in which the connecting assembly comprises:

at least one guide plate mounted on at least a selected one of the first and second bases, the guide plate comprising a slot; and at least one rod mounted to the central seat cushion subassembly, said at least one rod being partially positioned into the slot, wherein said at least one rod moves along the slot as the central seat cushion subassembly moves between the first and second positions, to guide the central seat cushion therebetween.

11. The convertible sofa bed system according to claim 10 in which:

the center body module comprises a central base positioned to support the central seat cushion subassembly, when the central seat cushion subassembly is in the first position thereof;

the center body module additionally comprises a latch subassembly, the latch subassembly comprising:

a catch element mounted on the central base;

a latch element positioned on the central bottom surface for engagement with the catch element when the central seat cushion subassembly is in the second position, whereby the central seat cushion subassembly is thereby held in the second position;

a release lever;

a cable extending between the release lever and the latch element, and the release lever being movable between an actuating position, in which the release lever pulls the cable, to disengage the latch element from the catch element, and a non-actuating position, in which the release lever does not pull the cable.

12. A method of moving a convertible sofa bed system between a seating configuration and a sleeping configuration, the method comprising:

(a) providing a back support assembly extending between first and second ends thereof, the back support assembly comprising a frame;

(b) providing at least one back cushion assembly comprising:

a first cushion;

a second cushion;

at least one connecting element, connecting the first and second cushions, said at least one back cushion assembly being movable between a raised condition thereof in which the sofa bed system is in the seating configuration thereof, and a lowered condition thereof, in which the sofa bed system is in the sleeping configuration;

(c) providing at least one body module secured to the frame, said at least one body module comprising at least one seat cushion comprising at least one at least partially planar top surface positionable at a predetermined elevation above the floor, wherein the back support assembly comprises:

a front side thereof facing toward said at least one body module;

an opposed back side thereof;

(d) when said at least one back cushion assembly is in the raised condition, moving said at least one back cushion assembly to an intermediate condition between the raised and lowered conditions;

(e) moving said at least one back cushion assembly from the intermediate condition thereof to the lowered condition thereof, by:

pivoting the first cushion away from the back support assembly about an axis defined by the connecting element, to locate a back side of the first cushion on the top surface; and horizontally moving the first and second cushions toward a front side of the back support assembly, to position a first end side of the second cushion in a recess formed in the front side of the back support assembly.

* * * * *